US011486119B2

(12) United States Patent
Lorkowski et al.

(10) Patent No.: US 11,486,119 B2
(45) Date of Patent: Nov. 1, 2022

(54) UNIVERSAL BATHTUB DRAIN AND OVERFLOW SYSTEM AND KIT

(71) Applicant: Oatey Co., Cleveland, OH (US)

(72) Inventors: Aaron Lorkowski, North Ridgeville, OH (US); Jian Zhang, Shanghai (CN); Blake Oatey, Rocky River, OH (US); Matthew Siena, East Hampton, CT (US); Christopher S. Graham, Portland, CT (US)

(73) Assignee: Oatey Co., Cleveland, OH (US)

( * ) Notice: Subject to any disclaimer, the term of this patent is extended or adjusted under 35 U.S.C. 154(b) by 0 days.

(21) Appl. No.: 17/348,117

(22) Filed: Jun. 15, 2021

(65) Prior Publication Data

US 2021/0388587 A1 Dec. 16, 2021

Related U.S. Application Data

(60) Provisional application No. 63/039,125, filed on Jun. 15, 2020.

(51) Int. Cl.
*E03C 1/232* (2006.01)

(52) U.S. Cl.
CPC ..... *E03C 1/232* (2013.01)

(58) Field of Classification Search
CPC ..... E03C 1/232; E03C 1/24; E03C 1/244
USPC ..... 4/680
See application file for complete search history.

(56) References Cited

U.S. PATENT DOCUMENTS 6,192,531 B1 * 2/2001 Fritz ..... E03C 1/24 285/46
6,606,753 B2 8/2003 Minnick
6,618,875 B1 9/2003 Oropallo et al.
6,637,050 B1 10/2003 Ball
6,675,406 B2 1/2004 Ball
6,681,420 B1 1/2004 Ball
6,836,911 B2 1/2005 Minnick
(Continued)

FOREIGN PATENT DOCUMENTS

WO 9729249 A1 8/1997

OTHER PUBLICATIONS

'The "Watco System"—A Family of Quality Bath Waste Products', Product Focus: Kitchen & Bath, Southern PHC, Southern PlumbingHeating•Cooling Magazine, Jun. 1, 2008; pp. 10-12, 4 pgs.

(Continued)

*Primary Examiner* — Benjamin R Shaw

(74) *Attorney, Agent, or Firm* — Alix, Yale & Ristas, LLP

(57) ABSTRACT

A waste and overflow system for a bathtub includes an overflow assembly, a drain assembly, and a plumbing assembly. The overflow assembly or kit includes an elbow pipe attachable to the plumbing assembly, a seal member positioned between an end of the elbow pipe and the bathtub, and a retainer ring that is threadingly connected to the elbow pipe to sandwich the seal member between a portion of the elbow pipe and the outer surface of the bathtub. The overflow assembly or kit further includes a faceplate operatively connected to the retainer ring. The faceplate can be formed as a screwless faceplate directly connected to the retainer ring in a first operative mode or a screwable faceplate attached by a screw to an adapter that is connected to the retainer ring in a second operative mode.

16 Claims, 24 Drawing Sheets

(56) References Cited

U.S. PATENT DOCUMENTS

| | | | | |
|---|---|---|---|---|
| 6,845,528 | B2 | 1/2005 | Bantz | |
| 6,901,611 | B2 | 6/2005 | McEntire et al. | |
| 7,127,752 | B2 | 10/2006 | Ball | |
| 7,185,529 | B2 | 3/2007 | Ball et al. | |
| 7,237,280 | B1 | 7/2007 | Holden, Jr. et al. | |
| 7,278,187 | B2 | 10/2007 | Witzleben | |
| 7,392,553 | B2 | 7/2008 | Uhl et al. | |
| D627,863 | S | 11/2010 | Ball | |
| 8,028,357 | B2 | 10/2011 | Ball | |
| 8,166,584 | B2 | 5/2012 | Ball | |
| D665,062 | S | 8/2012 | Ball | |
| 8,266,735 | B2 | 9/2012 | McLeod | |
| 3,302,220 | A1 | 11/2012 | Ball | |
| 8,321,970 | B2 | 12/2012 | Ball | |
| 8,336,131 | B2 | 12/2012 | Ball et al. | |
| 8,336,132 | B2 | 12/2012 | Ball et al. | |
| 8,505,132 | B2 | 8/2013 | Ball | |
| 8,584,272 | B2 | 11/2013 | Ball | |
| 8,769,736 | B2 | 7/2014 | Ball | |
| 8,782,824 | B2 | 7/2014 | Shoop et al. | |
| 8,887,325 | B2 | 11/2014 | Antoniello | |
| 9,045,886 | B2 | 6/2015 | Ball et al. | |
| 9,157,221 | B2 | 10/2015 | Pan | |
| 9,157,222 | B2 | 10/2015 | Homami et al. | |
| 9,181,686 | B2 | 11/2015 | Marotz et al. | |
| 9,200,436 | B2 | 12/2015 | Ball | |
| 9,260,846 | B2 | 2/2016 | Marotz et al. | |
| 9,267,274 | B2 | 2/2016 | Ball et al. | |
| 9,435,109 | B2 | 9/2016 | Ball et al. | |
| 9,663,930 | B2 | 5/2017 | Ball | |
| 9,702,129 | B2 | 7/2017 | Homami et al. | |
| 9,714,504 | B2 | 7/2017 | Bird et al. | |
| 9,816,258 | B2 | 11/2017 | Marotz et al. | |
| 9,890,522 | B2 | 2/2018 | Homami et al. | |
| 9,896,827 | B1 | 2/2018 | Hsieh et al. | |
| 9,982,424 | B1 | 5/2018 | Kuo et al. | |
| 10,017,925 | B1 * | 7/2018 | Kuo | E03C 1/24 |
| 10,329,752 | B2 | 6/2019 | Ball | |
| 10,443,220 | B2 | 10/2019 | Ball et al. | |
| 10,544,572 | B2 | 1/2020 | Humber et al. | |
| 10,563,385 | B1 * | 2/2020 | Ball | E03C 1/232 |
| 10,948,374 | B2 | 3/2021 | Graham et al. | |
| 2002/0032926 | A1 | 3/2002 | Lewis | |
| 2003/0000012 | A1 * | 1/2003 | Ball | E03C 1/24 4/680 |
| 2004/0055083 | A1 | 3/2004 | Ball | |
| 2004/0055084 | A1 | 3/2004 | Ball | |
| 2010/0037392 | A1 * | 2/2010 | Ball | E03C 1/232 4/683 |
| 2010/0163131 | A1 | 7/2010 | Fehr et al. | |
| 2011/0000014 | A1 * | 1/2011 | Ball | E03C 1/232 4/679 |
| 2012/0005824 | A1 * | 1/2012 | Ball | E03C 1/24 4/680 |
| 2015/0089736 | A1 * | 4/2015 | Bird | E03C 1/22 4/680 |
| 2015/0121617 | A1 * | 5/2015 | Ball | E03C 1/22 4/680 |
| 2015/0152627 | A1 * | 6/2015 | Ball | E03C 1/24 4/680 |
| 2017/0247867 | A1 | 8/2017 | Ball | |
| 2018/0044899 | A1 * | 2/2018 | Ball | E03C 1/244 |
| 2018/0305910 | A1 * | 10/2018 | Heipp | E03C 1/232 |
| 2019/0376267 | A1 | 12/2019 | Ball | |

OTHER PUBLICATIONS

"Full Kits Breakaway Head Lift & Turn" see p. 24, Breakaway Test Cap, JB Products, Full Line Catalog 2014, Jan. 1, 2014, 96 pgs.

* cited by examiner

UNIVERSAL BATHTUB DRAIN AND OVERFLOW SYSTEM AND KIT

TECHNICAL FIELD

This disclosure relates generally to bathtub drain and overflow assemblies.

BACKGROUND

Conventional bathtub drain and overflow systems are designed to provide fluid drainage from a bathtub, or other liquid-holding tank, and into a drain pipe. Typical systems include both overflow and drain aspects to provide drainage, respectively, from an overflow port and a drain port of the tub, and directing this water (or other fluid medium) out of the bathtub and into a central drainage system (such as a septic system or public sewage disposal system). The overflow port permits the drainage of water when the water level exceeds a predetermined height in the tub, i.e., to prevent the water from overflowing. The drain port allows a user to manually control whether the drain port is open or closed for allowing the water to drain out of the tub or for preventing the water from draining out of the tub, respectively.

Typical overflow assemblies include a decorative faceplate that attaches to a support structure by a screw inserted through the face of the faceplate. Many users do not find the screw through the faceplate to be aesthetically pleasing. Other overflow assemblies have a faceplate that does not require a screw to attach the faceplate to a support structure, which makes for a more aesthetically pleasing design to some users. However, if a user wants to replace one type of faceplate for the other, the overflow assemblies are not configured to allow such a replacement.

SUMMARY

A need therefore exists for a universal overflow assembly that allows both a screwless faceplate attachment as well as a screwable faceplate attachment to a support structure.

In one aspect of the present invention, a universal overflow kit for a bathtub is provided. The universal overflow assembly kit includes an elbow pipe having a first end and a second end, wherein the second end includes internal threads. The kit further includes a seal member positioned adjacent to and surrounding the second end of the elbow pipe, the seal member being positioned between a portion of the second elbow and a sidewall of the bathtub. The kit also includes a retainer ring having a cylindrical body, wherein external threads are located adjacent to a first end of the body. A grip flange is located adjacent to an opposing second end of the body, and a snap ledge located adjacent to said second end of the body and extends radially inward from an inner surface of the body. The kit further includes an adapter having an annular ring with a plurality of arms extending radially inward and connected to a boss having a threaded aperture formed therethrough. The adapter further includes a plurality of snap tabs extending longitudinally from the ring for removably engaging the snap ledge of said retainer ring in a first operative mode. The universal kit includes a screwable faceplate having a threaded aperture formed therethrough, wherein a screw threadingly engages the threaded aperture of the screwable faceplate and the threaded aperture of said adapter for removably connecting the screwable faceplate to the adapter in the first operative mode. The universal kit also includes a screwless faceplate removably connected to the retainer ring in a second operative mode.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings.

DETAILED DESCRIPTION

Figure 1:
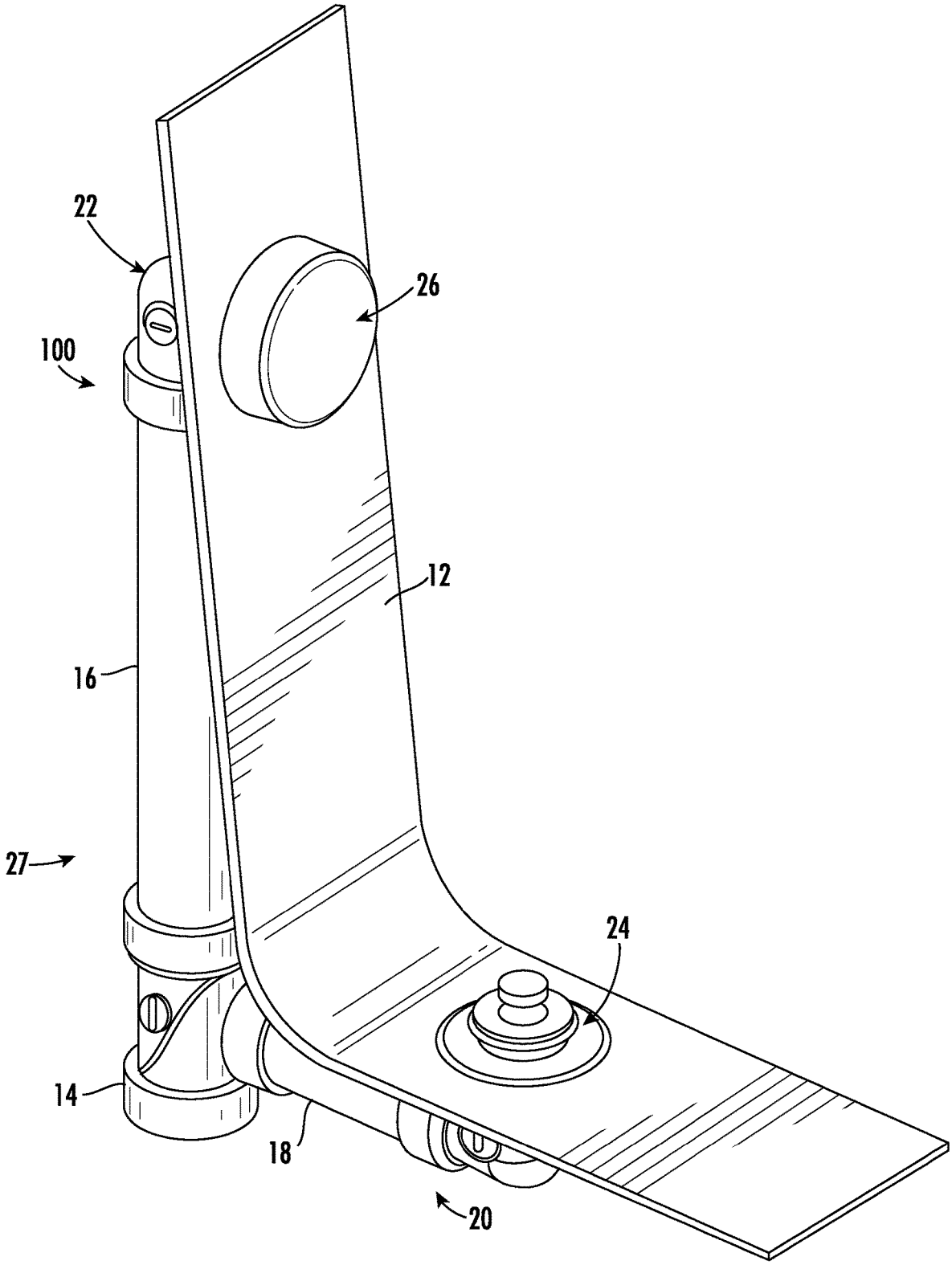
FIG. 1 illustrates an embodiment of a bathtub drain and overflow system connected to a portion of a bathtub.
Figure 2A:
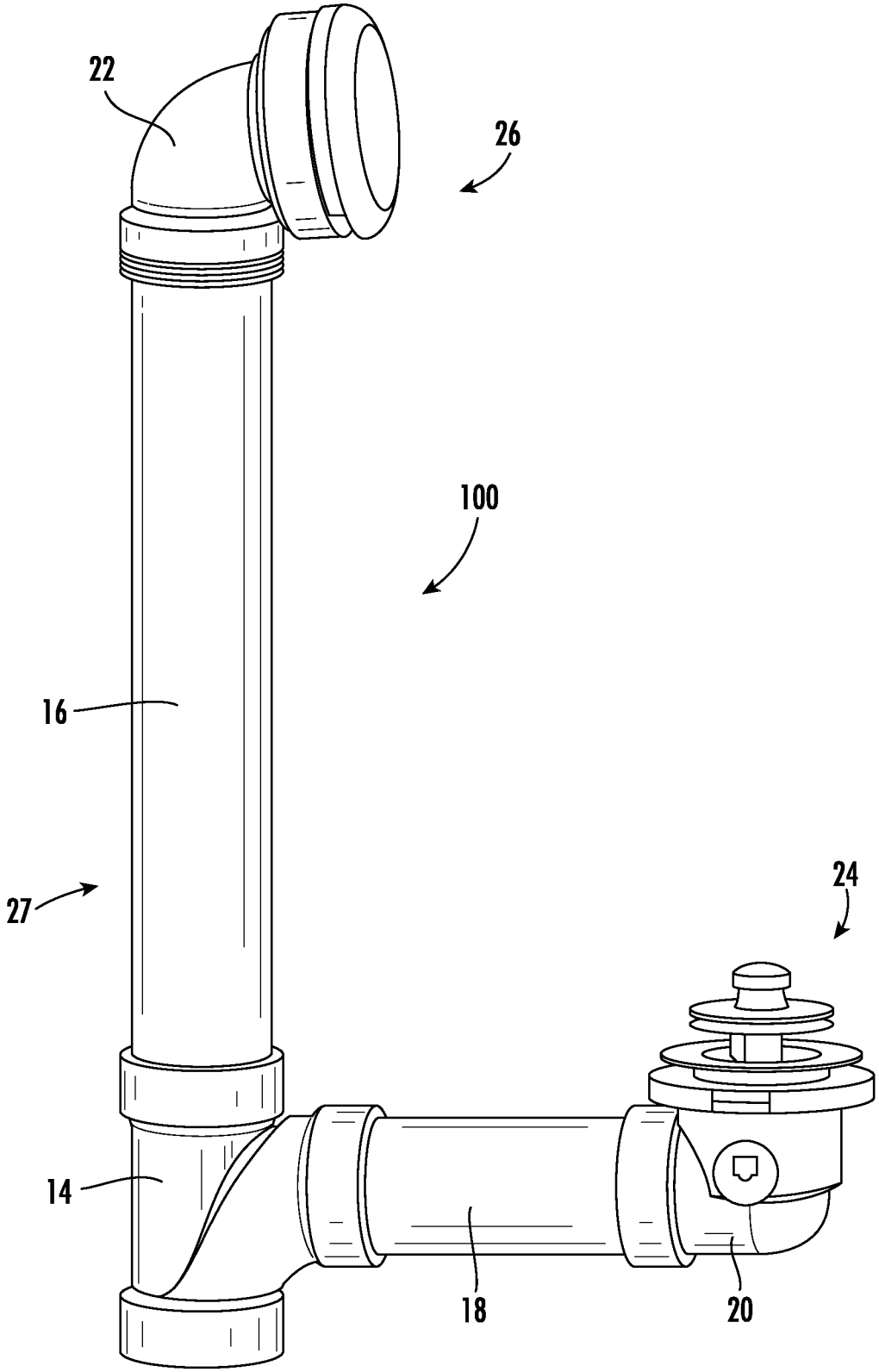
FIG. 2A illustrates a side view of the bath drain and overflow system of FIG. 1.
Figure 2B:
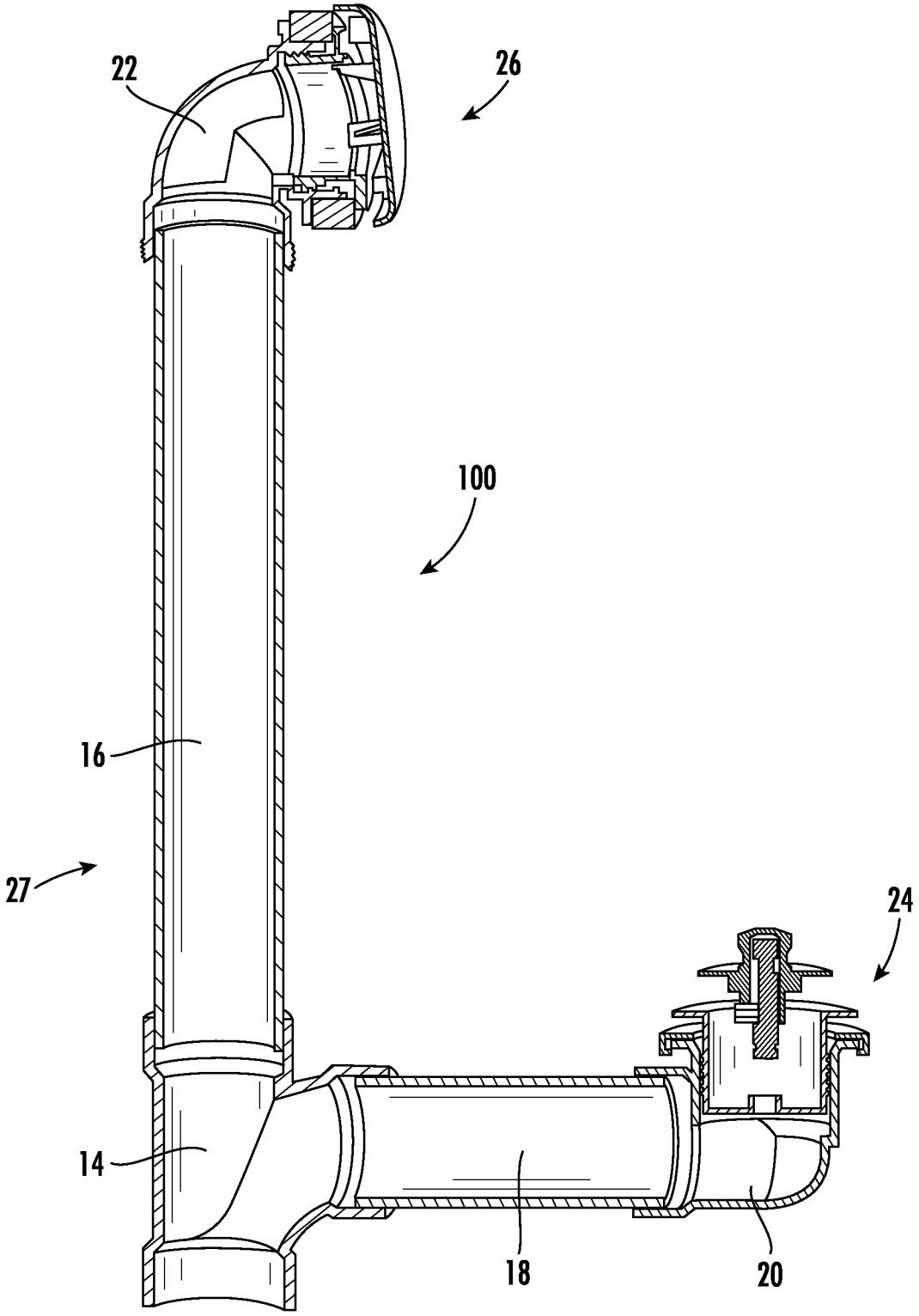
FIG. 2B illustrates a cross-sectional view of the bath drain and overflow system of FIG. 2A.

Referring to FIGS. 1 and 2A-2B, a bath drain and overflow system 100 for use with a bathtub 12 includes a drain assembly 24, an overflow assembly 26, and a plumbing assembly 27 according to an embodiment of the invention is shown. As shown, the system 100 is attached and mounted directly to a bathtub 12, which is partially illustrated for purposes of clarity. As one of skill in the art will appreciate, typical bathtub (or "tub") installations will provide for both overflow and drain connections which together direct water away from the tub and into a main drain system, terminating in a septic system or public sewage system. The illustrated plumbing assembly 27 for capturing water from both the overflow and drain assemblies includes a tee pipe 14 having a vertically oriented overflow pipe 16 and a horizontally oriented drain pipe 18 extending from adjacent openings of the tee pipe 14. The third opening of the tee pipe 14 is operatively and fluidly connected to the main waste pipe (not shown) or line that carries all waste water from a house or building to a public sewage system or a septic system. The overflow assembly 26 is connected to the overflow pipe 16 of the plumbing assembly 27, and the drain assembly 24 is connected to the drain pipe 18 of the plumbing assembly 27. A first elbow 20 of the drain assembly 24 is attached to the distal end of the drain pipe 18 opposite the tee pipe 14, and a second elbow 22 of the overflow assembly 26 is attached to the distal end of the overflow pipe 16 opposite the tee pipe 14. During installation, a portion of the second elbow 22 extends partially through the overflow port formed in the sidewall of the tub 12 and is configured to be operatively connected to a faceplate 28, 30 of the overflow assembly 26.

In some embodiments, the tee pipe 14, overflow pipe 16, drain pipe 18, first elbow 20, and second elbow 22 are all formed of the same material. In other embodiments, at least one of the tee pipe 14, overflow pipe 16, drain pipe 18, first elbow 20, and second elbow 22 is formed of a different material than one of the other components thereof. The tee pipe 14, overflow pipe 16, drain pipe 18, first elbow 20, and second elbow 22 can be formed of brass, polyvinyl chloride ("PVC"), or any other material that meets local building codes.

FIGS. 3A-3E and 4A-4F illustrate embodiments of an overflow assembly 26 that are attachable to the end of the overflow pipe 16 of the plumbing assembly 27. The embodiments of the overflow assembly 26 shown in FIGS. 3A-3E include a screwless faceplate 28. FIGS. 4A-4F illustrate embodiments of an overflow assembly 26 that are attachable to the end of the overflow pipe 16 of the plumbing assembly 27. The embodiments of the overflow assembly 26 shown in FIGS. 4A-4F include a screwable faceplate 30 and an adapter 32, 132.

Figure 8:
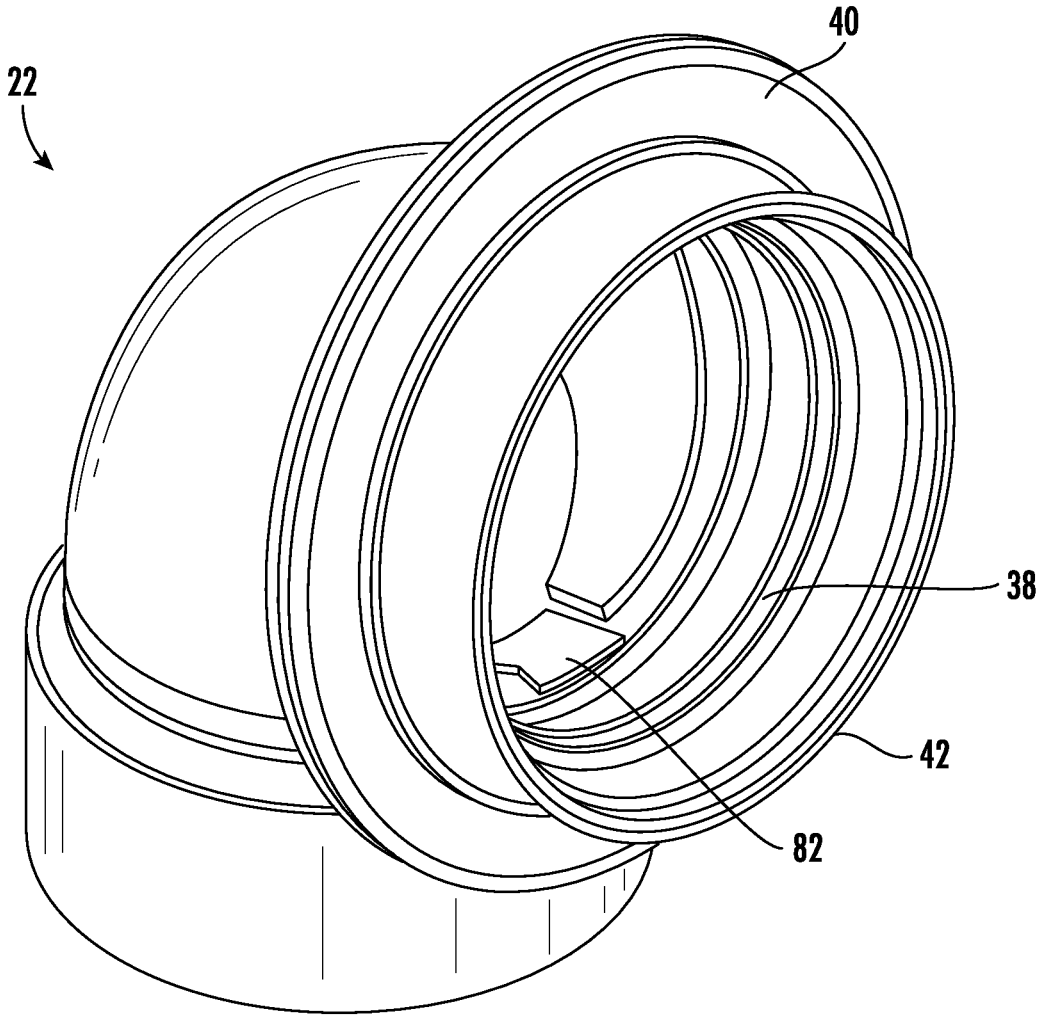
FIG. 8 is an isometric view of an embodiment of a second elbow.

In the embodiments illustrated in FIGS. 3A-3E and 4A-4F, the overflow assembly 26 includes the second elbow 22, a seal member 34, a retainer ring 36. In the embodiments shown in FIGS. 3A-3E, the overflow assembly 26 further includes a screwless faceplate 28, 128; and the embodiments shown in FIGS. 4A-4F, the overflow assembly 26 further includes a screwable faceplate 30. The second elbow 22 includes two opposing ends having openings, wherein the openings are fluidly connected therebetween. One end of the second elbow 22 is configured to receive the distal end of the overflow pipe 16 therein to operatively connect the second elbow 22 to the overflow pipe 16. The second elbow 22 is fixedly attached to the overflow pipe 16 by way of solvent cement (for plastic pipes) or by soldering (for a brass-to-brass connection). It should be understood by one having ordinary skill in the art that other manners of fixedly attaching one end of the second elbow 22 to the end of the overflow pipe 16 are contemplated. The second end 42 of the second elbow 22 is configured to receive the retainer ring 36 therein by way of a threaded connection. In the illustrated embodiment, the second end 42 of the second elbow 22 is internally threaded. The second elbow 22 further includes a radially-extending flange 40 that extends around the entire outer circumference of the second end 42 of the second elbow 22. The flange 40 is configured to contact the seal member 34 to sandwich the seal member 34 between the flange 40 of the second elbow 22 and the outer sidewall surface of the bathtub 12. In an embodiment, the flange 40 extends radially a sufficient distance to contact the entire first contact 44 surface of the seal member 34. In other embodiments, the flange 40 extends radially from the outer circumferential surface of the second elbow 22 a distance such that the flange 40 contacts only a portion of the first contact surface 44 of the seal member 34. The flange 40 is positioned adjacent to, and spaced apart from, the distal edge of the second end 42 of the second elbow 22. In the embodiment illustrated in FIGS. 4D and 8, the second elbow 22 includes a locking detent 82 formed into the inner surface thereof. The locking detent 82 is configured to receive the lock member 80 of the adapter 32 to prevent the adapter 32 from rotating relative to the second elbow 22 when the screwable faceplate 30 is attached to the adapter 32.

In an embodiment, the seal member 34 is positioned between the flange 40 of the second elbow 22 and the outer surface of the vertical sidewall of the tub 12 in a compressive, or sandwiched manner. As shown in FIGS. 3A-3E and 4A-4F, the seal member 34 is formed as an annular member forming a central bore configured to receive the second end 42 of the second elbow 22. In the illustrated embodiments, the seal member 34 has a square or rectangular cross-sectional shape, but it should be understood by one having ordinary skill in the art that the cross-sectional shape of the seal member 34 may also be round, oval, hexagonal, or any other shape sufficient to prevent water from leaking between the second elbow 22 and the tub 12. The seal member has a first contact surface 44 and an opposing second contact surface 46. In some embodiments, at least one of the first and second contact surfaces 44, 46 includes a glue or other adhesive applied thereto to provide for a more secure sealing attachment to the tub 12.

In an embodiment, the retainer ring 36 is configured to threadingly engage the second elbow 22, wherein the seal member 34 and the sidewall of the tub 12 are positioned therebetween in a sandwiching manner. In the embodiments shown in FIGS. 3A-3E and 4A-4F, the retainer ring 36 includes a central cylindrical body 48 having external threads 50 located adjacent to one end thereof and a grip flange 52 located adjacent to the opposing end thereof. The grip flange extends radially outward from the outer circumferential surface of the body 48. The retainer ring 36 further includes a snap ledge 54 extending radially inward from the inner surface of the body 48. The snap ledge 54 is configured to engage the lock members 80 that extend from the screwless faceplate 28 (FIGS. 3A-3E). The external threads 50 of the retainer ring 36 engage with the internal threads 38 of the second elbow 22 to form a threaded engagement therebetween.

As shown in FIGS. 3A-3E and 4A-4F, the grip flange 52 extends radially outward from the outer circumferential surface of the body 48 of the retainer ring 36. The grip flange 52 is positioned adjacent to or at the distal end of the body 48 opposite the external threads 50. The grip flange 52 is configured to allow a user to grasp the retainer ring 36 and rotate it to threadingly engage the grip flange 52 to the second elbow 22. The grip flange 52 is formed as a generally 6-point rounded star shape that provides recesses to receive a user's fingers to grasp and rotate the grip flange 52. It should be understood by one having ordinary skill in the art that the grip flange 52 can have any radial shape that allows a user to grasp the grip flange 52 to aid in rotation thereof.

The retainer ring 36 further includes a snap ledge 54 formed on the inner circumferential surface of the body 48, as shown in FIGS. 3A-3E and 4A-4F. The snap ledge 54 is configured to receive snap tabs 56 of the screwless faceplate 28 as well as the snap tabs 78, 178 of the adapter 32, 132. The snap ledge 54 is a generally annular protrusion that extends radially inward from the inner circumferential surface of the body 48 a distance sufficient to provide a surface or ledge against which the snap tabs 56 and snap tabs 78, 178 engage. In the illustrated embodiments, the snap ledge 54 is spaced apart from the distal edge and opening of the body 48. In other embodiments, the snap ledge 54 is positioned at the distal edge of the body 48 such that the snap ledge 54 forms a portion of the distal edge of the body 48.

In another embodiment, the retainer ring 36 includes a removable test plug (not shown) integrally formed therewith that is removable after pressure testing a home or building plumbing system, as described (as the "test cap 14") in more detail in U.S. patent application Ser. No. 16/403,872 entitled "Tub Overflow Drain Test System." the portion of which that relates to the test cap 14 is incorporated by reference herein.

The embodiments of the overflow assembly 26 shown in FIGS. 3A-3E include screwless faceplates 28, 128 that are configured to conceal the remaining components of the overflow assembly 26 as well as provide a pathway to allow water to flow to the plumbing assembly 27 when the water level in the tub 12 goes above a pre-determined height. The embodiment of the screwless faceplate 28 shown in FIGS. 3A-3C includes a face wall 58 having a curved transition portion 60 integrally formed with the face wall 58, and a sidewall 62. The face wall 58 has an outer surface that, when installed, is directed toward the interior of the tub 12 and an inner surface directed toward the retainer ring 36 wherein the transition portion 60 extends between the face wall 58 and a cylindrical sidewall 62. The face wall 58 includes a plurality of snap tabs 56 extending longitudinally from the inner or rear surface that is directed toward the tub 12 when installed. Each of the snap tabs 56 is an elongated resilient member having a snap edge 64 configured to engage the snap ledge 54 of the retainer ring 36 to releasably connect the screwless faceplate 28 to the retainer ring 36. In some embodiments, the snap tabs 56 are hook shaped having a snap ledge 54 that is directed toward the inner or rear surface of the face wall 58. In an embodiment, the face 58 of the screwless faceplate 28 includes three (3) snap tabs 56 extending from the inner surface of the face wall 58. In other embodiments, the face wall 58 of the screwless faceplate 28 includes more than three snap tabs 56 extending from the inner surface thereof. A notch 66 is formed into a portion of the sidewall 62, wherein the notch 66 extends longitudinally from the longitudinal edge of the sidewall 62 about a portion of the circumferential sidewall 62. In an embodiment, the notch 66 extends about between about 10° to 180° of the sidewall 62.

Figure 3A:
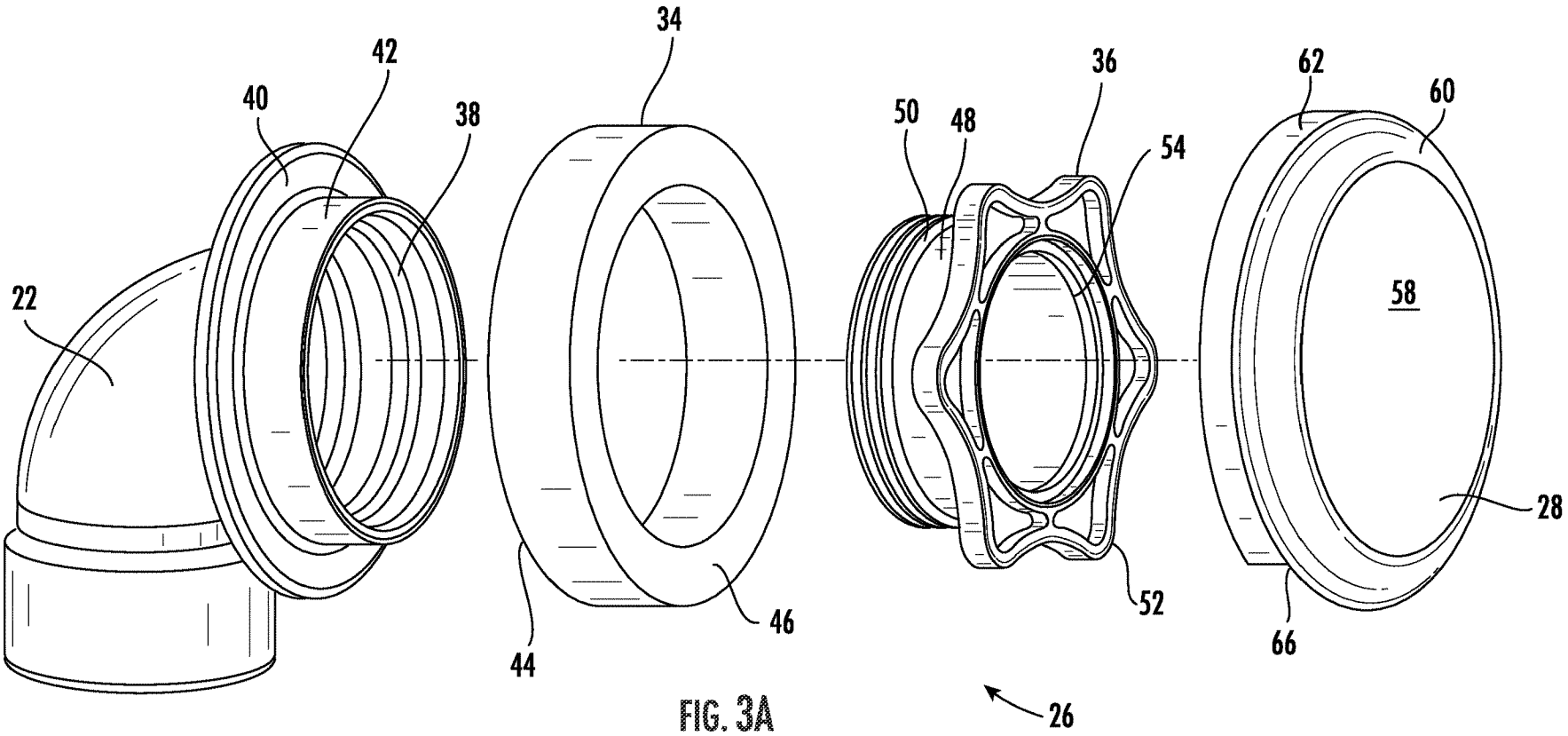
FIG. 3A is an exploded view of an exemplary embodiment of an overflow assembly having a screwless faceplate in a first operative mode.
Figure 3B:
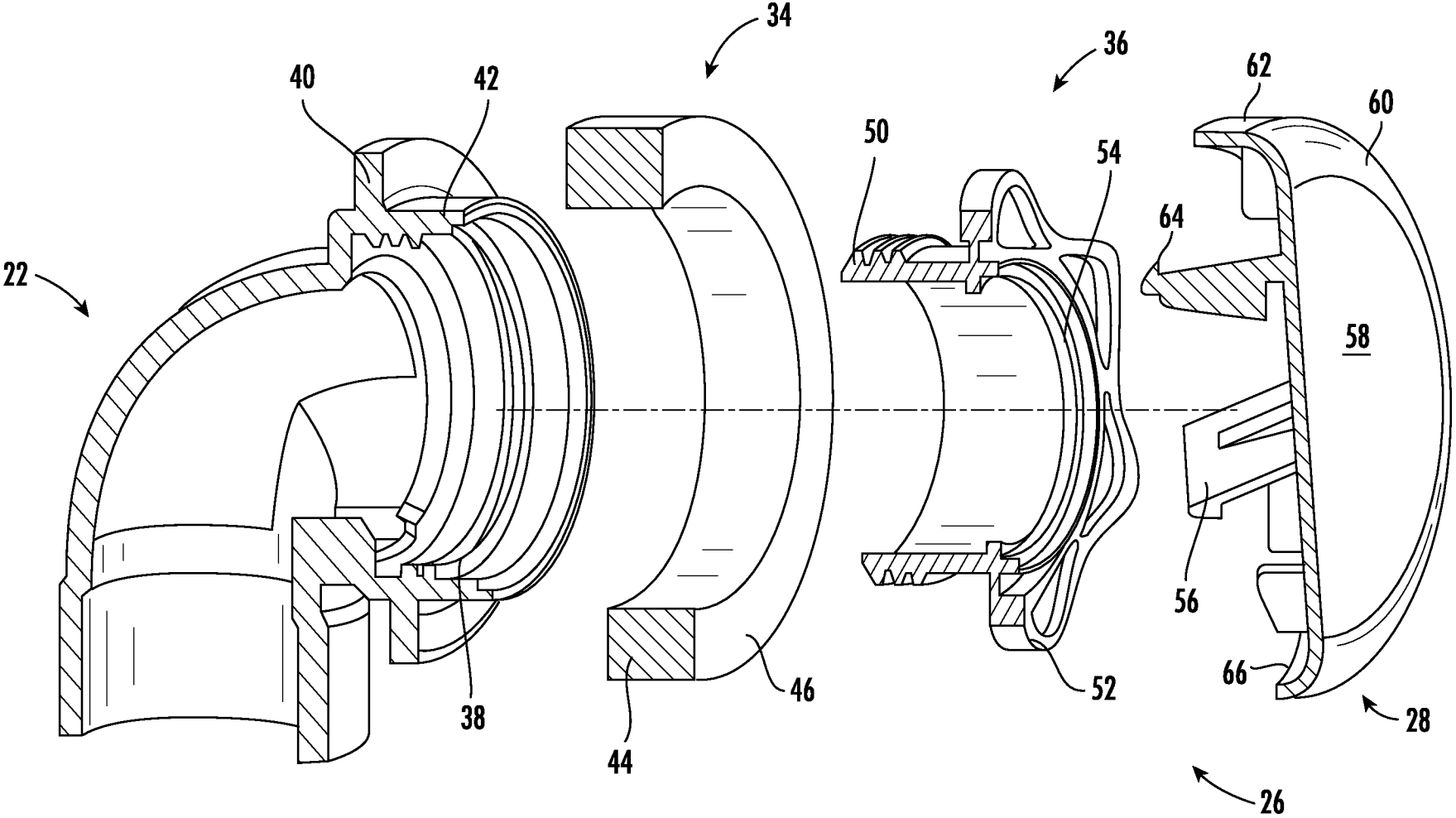
FIG. 3B is an exploded cross-sectional view another embodiment of an overflow assembly having a screwless faceplate shown in FIG. 3A.
Figure 3C:
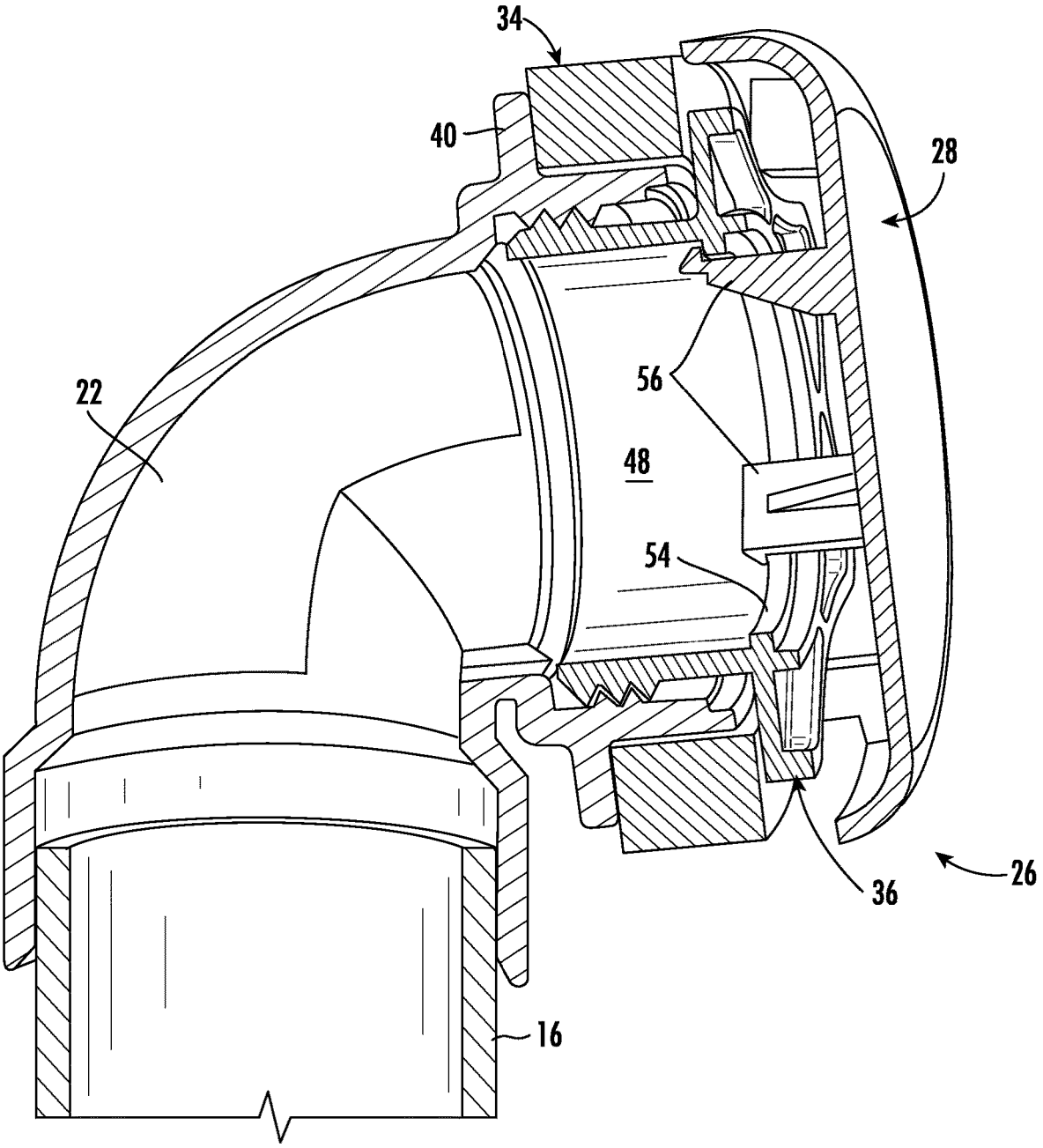
FIG. 3C is an assembled cross-sectional view of the overflow assembly having a screwless faceplate shown in FIG. 3A.
Figure 3D:
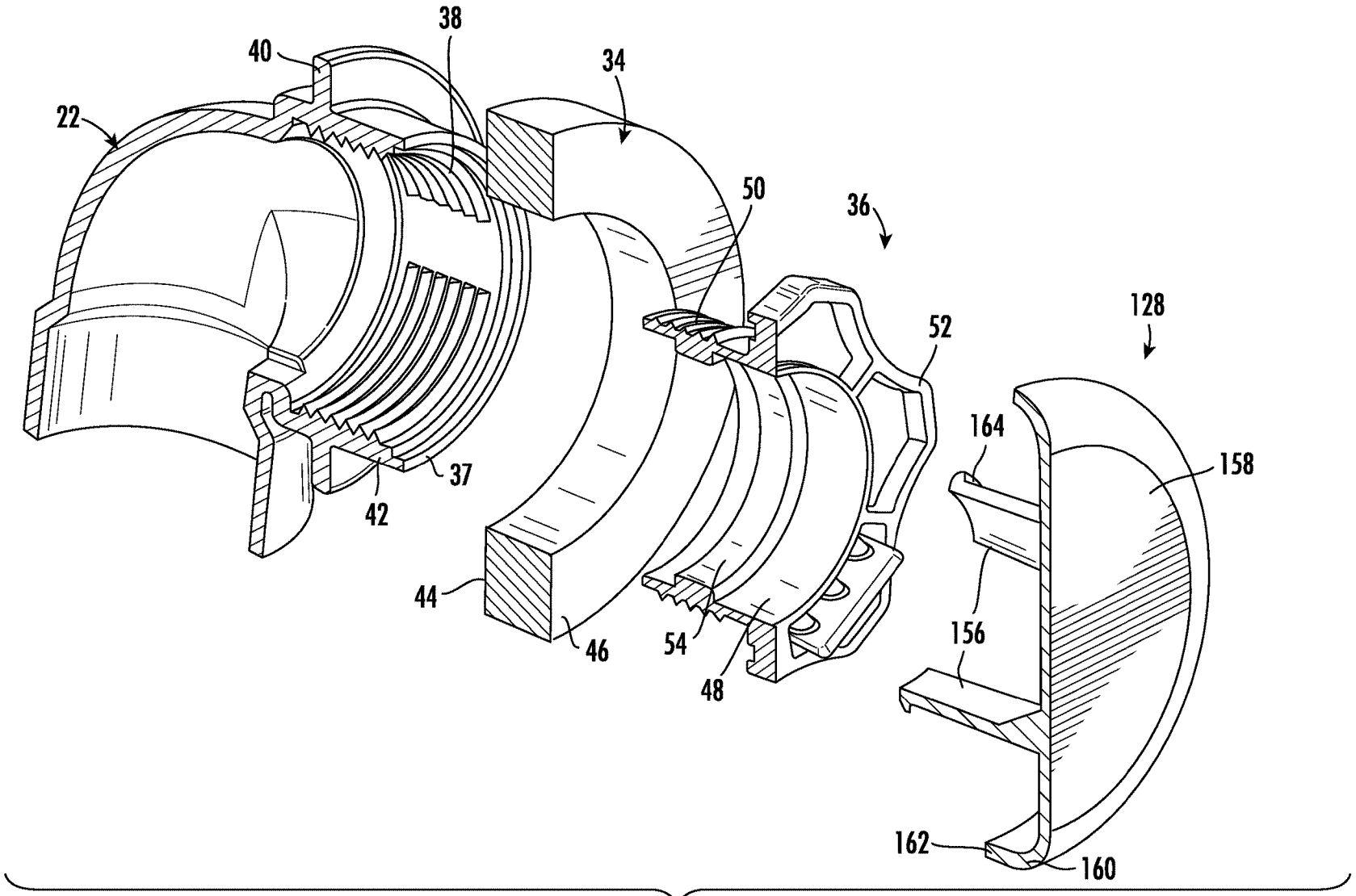
FIG. 3D is an exploded cross-sectional view of another embodiment of an overflow assembly having a screwless faceplate in a first operative mode.
Figure 3E:
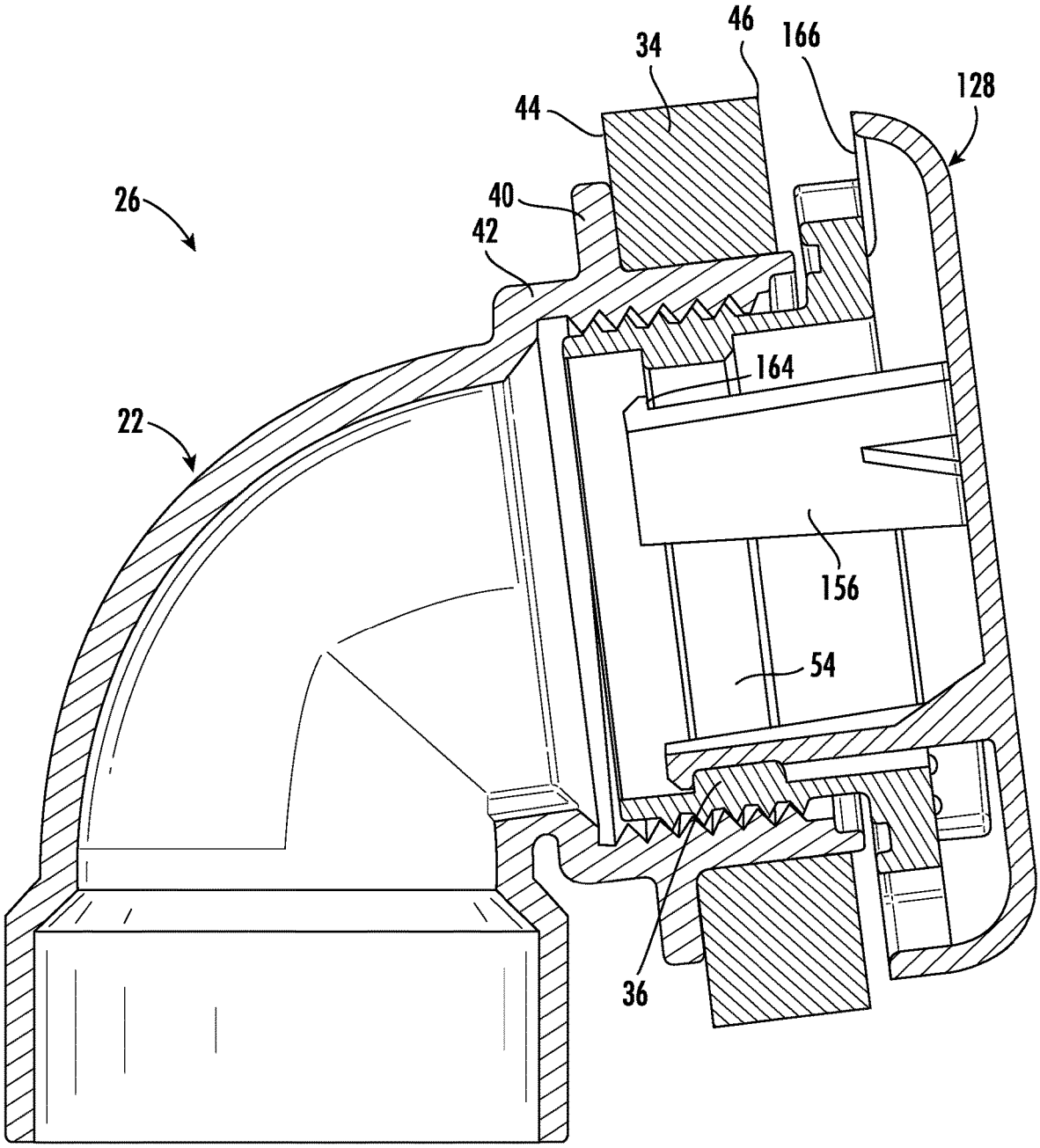
FIG. 3E is an assembled cross-sectional view of the overflow assembly having a screwless faceplate shown in FIG. 3D.

The embodiment of the screwless faceplate 128 sown in FIGS. 3D-3E includes a face wall 158 having a curved transition portion 160 integrally formed with the face wall 158, and a sidewall 162. The face wall 158 has an outer surface that, when installed, is directed toward the interior of the tub 12 and an inner surface directed toward the retainer ring 36 wherein the transition portion 160 extends between the face wall 158 and a cylindrical sidewall 162. The face wall 158 includes a plurality of snap tabs 156 extending longitudinally from the inner or rear surface that is directed toward the tub 12 when installed. Each of the snap tabs 156 is an elongated resilient member having a snap edge 164 configured to engage the snap ledge 154 of the retainer ring 136 to releasably connect the screwless faceplate 128 to the retainer ring 136. In some embodiments, the snap tabs 156 are hook shaped having a snap ledge 154 that is directed toward the inner or rear surface of the face wall 158. In an embodiment, the face wall 158 of the screwless faceplate 128 includes three (3) snap tabs 156 extending from the inner surface of the face wall 158. In other embodiments, the face wall 158 of the screwless faceplate 128 includes more than three snap tabs 156 extending from the inner surface thereof. A notch 166 is formed into a portion of the sidewall 162, wherein the notch 166 extends longitudinally from the longitudinal edge of the sidewall 162 about a portion of the circumferential sidewall 162. In an embodiment, the notch 166 extends about between about 10° to 180° of the sidewall 162. The snap tabs 156 of the screwless faceplate 128 illustrated in FIGS. 7E-7H extend a greater distance than the snap tabs 156 extend from the screwless faceplate 28 illustrated in FIGS. 7A-7D in order to allow the snap edges 164 to engage the snap ledge 54 of the retainer ring 36 shown in FIGS. 3D-3E that is positioned at a different location on the inner wall than the snap ledge 54 of the retainer ring 36 shown in FIGS. 3A-3C. To assemble the overflow assembly 26 having a screwless faceplate 28, 128 shown in FIGS. 3A-3E, the second elbow 22 is attached to the distal end of the overflow pipe 16. The seal member 34 is then positioned about the second end 42 of the second elbow 22 such that the seal member 34 is positioned between the second elbow 22 and the outer surface of the sidewall of the tub 12. When properly installed, a portion of the second end 42 of the second elbow 22 extends through the overflow port formed into the sidewall of the tub 12 and into the volume of the tub 12. The retainer ring 36 is then positioned such that the outer threads 50 thereof engage the inner threads 38 of the second elbow 22, wherein the retainer ring 36 is screwed into the second elbow 22 to sandwich the sidewall of the tub 12 and the seal member 34 between the retainer ring 36 and the second elbow 22. Once the retainer ring 36 is secured to the second elbow 22, the snap tabs 56, 156 of the screwless faceplate 28, 128 are inserted into the central bore defined by the body 48 of the retainer ring 36 until the snap edges 64, 164 of the snap tabs 56, 156 engage the snap ledge 54 of the retainer ring 36. In some embodiments, the screwless faceplate 28, 128 is oriented such that the notch 66 is directed downwardly within the tub 12. In other embodiments, the screwless faceplate 28, 128 is oriented such that the notch 66 is directed upwardly within the tub 12. As a result, the screwless faceplate 28, 128 is operatively connected to the retainer ring 36 in a first operative mode.

FIGS. 4A-4F illustrate other embodiments of the overflow assembly 26, wherein the overflow assembly 26 includes a screwable faceplate 30. The overflow assembly 26 includes the second elbow 22, the seal member 34, and the retainer ring 36 describe above and shown in FIGS. 3A-3E. The embodiments of the overflow assembly 26 shown in FIGS. 4A-4F include an adapter 32, 132 with a screwable faceplate 30 attachable thereto.

The embodiment of the adapter 32 of the overflow assembly 26 shown in FIGS. 4A-4D and FIGS. 6A-6D is configured to allow a screwable faceplate 30 to be removably connected thereto. In a similar manner, the embodiment of the adapter 132 of the overflow assembly 26 shown in FIGS. 4E-4F and 6E-6H is also configured to allow a screwable faceplate 30 to be removably connected thereto.

Figure 4A:
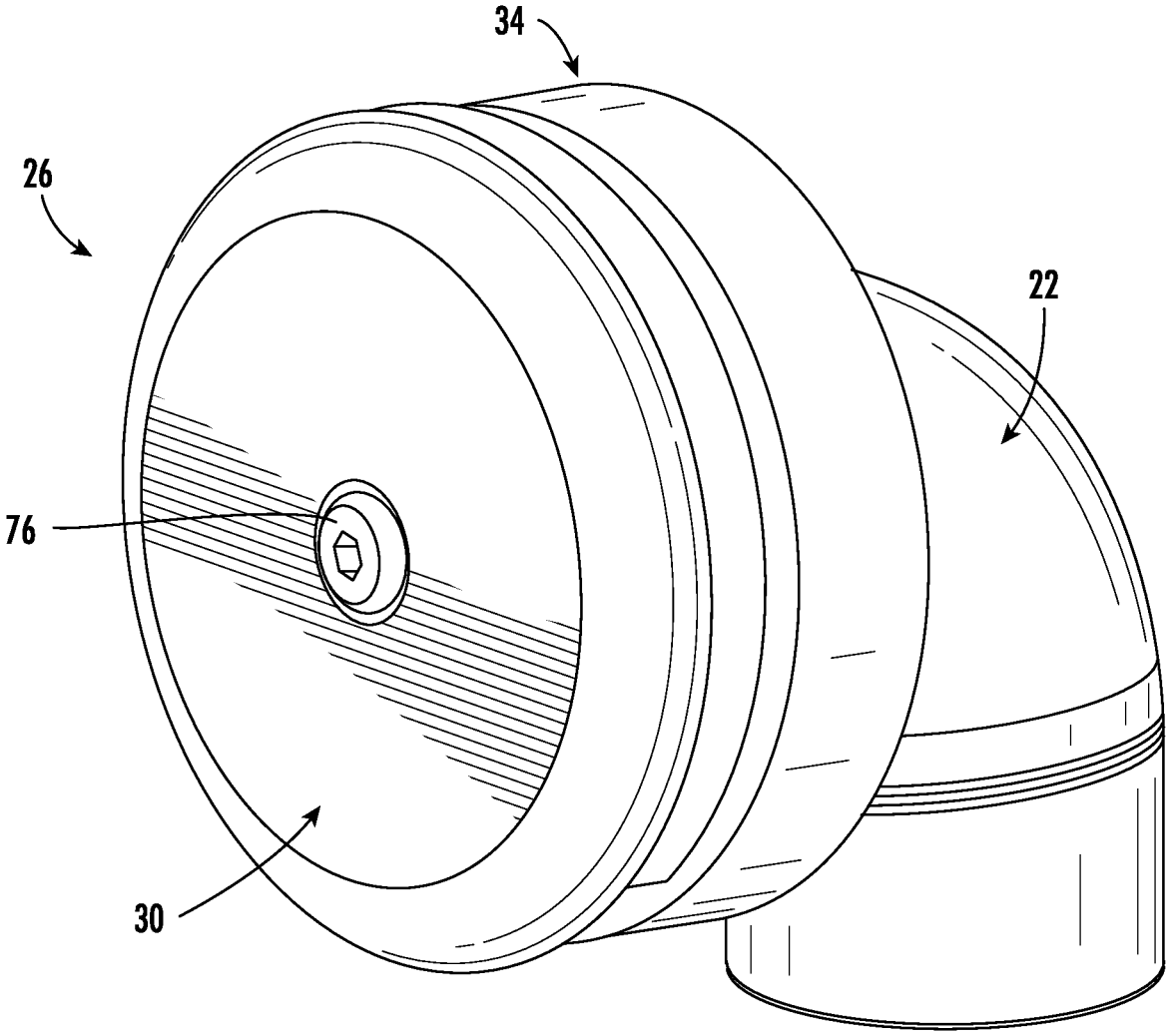
FIG. 4A is an isometric view of another embodiment of an overflow assembly having a screwable faceplate in a second operative mode.
Figure 4B:
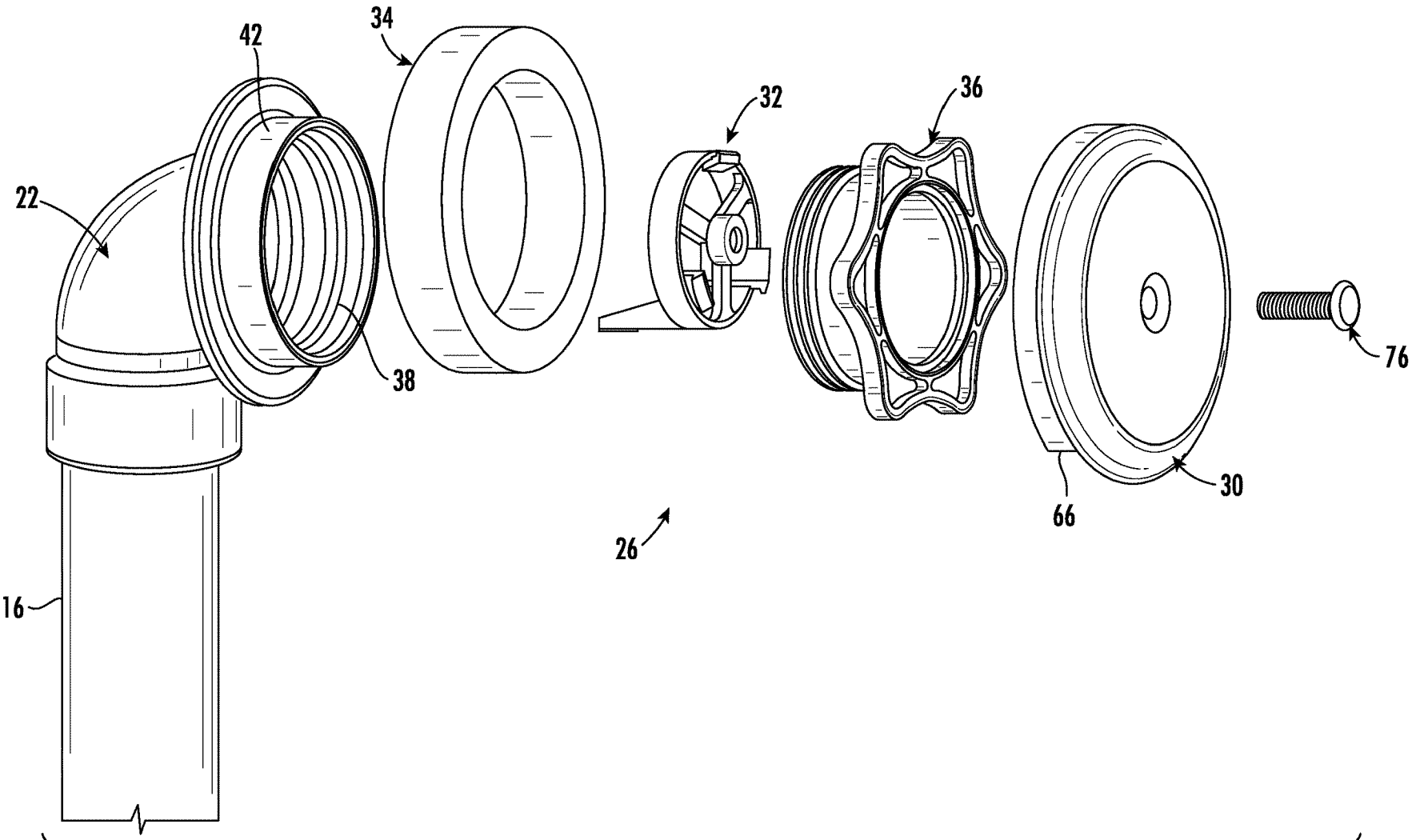
FIG. 4B is an exploded view of the overflow assembly having a screwable faceplate shown in FIG. 4A.
Figure 4C:
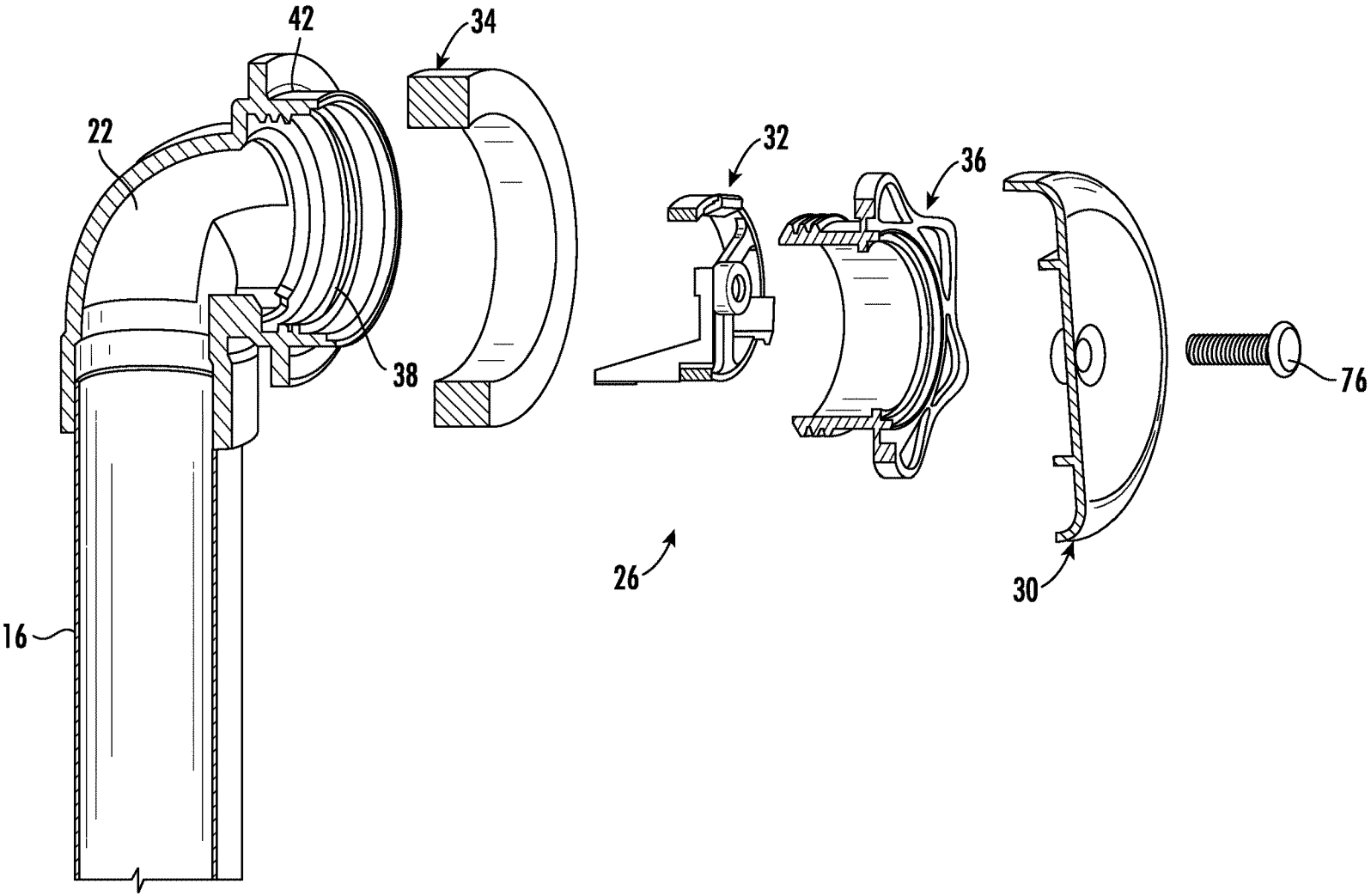
FIG. 4C is an exploded cross-sectional view of the overflow assembly having a screwable faceplate shown in FIG. 4A.
Figure 4D:
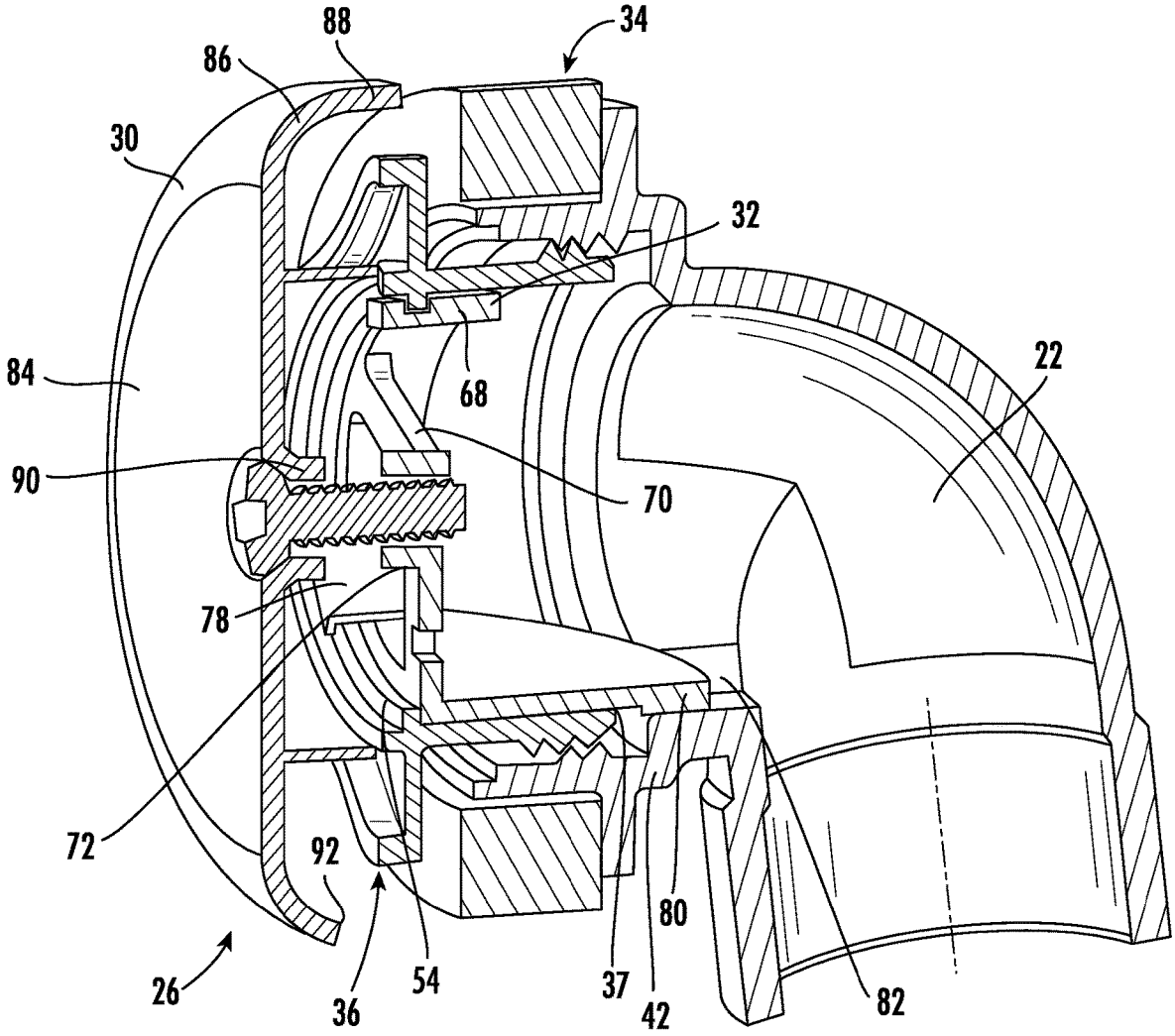
FIG. 4D is an assembled cross-sectional view of the overflow assembly having a screwable faceplate shown in FIG. 4A.

As shown in FIGS. 4A-4D and 6A-6D, the illustrated adapter 32 is a generally circular member having an annular ring 68 with a plurality of arms 70 integrally formed with the ring 68, wherein the arms 70 extend radially inward to a junction that forms a raised boss 72. An internally-threaded aperture 74 is formed through the thickness of the boss 72. The threaded aperture 74 is configured to receive a screw 76 for attaching the screwable faceplate 30 to the adapter 32. In the illustrated embodiment, the boss 72 extends longitudinally above the upper surface of the ring 68 and arms 70, but it should be understood by one having ordinary skill in the art that the boss 72 formed at the junction of the arms 70 can be flush with the upper surface of the ring 68 and arms 70. The adapter 32 further includes a plurality of snap tabs 78 that extend longitudinally away from the upper surface of the ring 68 and arms 70. The snap tabs 78 are generally hook-shaped to create a snap edge 64 configured to engage with the snap ledge 54 of the retainer ring 36. In an embodiment, the snap tabs 78 are configured to releasably engage the snap ledge 54 of the retainer ring 36. In other embodiments, the snap tabs 78 are configured to engage the snap ledge 54 of the retainer ring 36 in an abutting manner without positively securing the adapter 32 to the retainer ring 36. The adapter 32 is installed by inserting it through the opening at the end of the retainer ring 36 until the snap tabs 78 of the adapter 32 engage the snap edge 54 of the retainer ring 36. When properly positioned within the retainer ring 36, the boss 72 is located at substantially the center of the retainer ring 36 to receive a single screw 76 for attaching the screwable faceplate 30 thereto. It should be understood by one having ordinary skill in the art that although the embodiment of the adapter 32 shown includes only a single threaded boss 72 for receiving one screw for securing a screwable faceplate 30 thereto, other embodiments can be configured to provide a plurality of threaded bosses 72 for attaching screwable faceplates 30 that require a plurality of screws for attaching the screwable faceplate 30 to the adapter 32. In an embodiment, the adapter 32 further includes a lock member 80 extending from the ring 68 in the opposite longitudinal direction relative to the snap tabs 78, as shown in FIGS. 4B and 6A-6C. The lock member 80 is configured to be received in the locking detent 82 formed in the inner surface of the second end 42 of the second elbow 22, as shown in FIG. 4D. When the lock member 80 is received with the locking detent 82 of the second elbow 22, the adapter 32 is prevented from rotating relative to the second elbow 22 when the screwable faceplate 30 is attached to the adapter 32 with the screw 76.

As shown in FIGS. 4E-4F and 6E-6H, the illustrated adapter 132 is a generally cylindrical member having an annular ring 168 having an upper end and a lower end thereof, wherein the upper and lower ends form substantially parallel surfaces. The adapter 132 further includes a plurality of arms 170 integrally formed with the ring 168, wherein the arms 170 extend radially inward to a junction that forms a boss 172. The arms 170 extend from the inner surface of the ring 168 at a location adjacent to or at the lower end of the ring 168. In the illustrated embodiment, a support member extends from each arm and is integrally connected to the outer surface of the boss 172 to provide structural support for the boss 172. An internally-threaded aperture 174 is formed through the axial thickness of the boss 172. The threaded aperture 174 is configured to receive a screw 76 for attaching the screwable faceplate 30 to the adapter 132. In the illustrated embodiment, the boss 172 extends longitudinally above the upper surface of arms 170 toward the upper end of the ring 168, wherein a portion of the boss 172 is positioned within the ring 168 and another portion of the boss 172 extends axially above the upper end of the ring 168.

In the embodiment illustrated in FIGS. 4E-4F and 6E-6H, the adapter 132 further includes at least one snap tab 178 that extends from the lower end of the ring 168. The snap tab 178 is generally hook-shaped to create a ledge configured to engage the lower end of the snap ledge 54 of the retainer ring 36. The adapter 132 also includes a flange 181 that extends radially outward from the upper end of the ring 168. In an embodiment, the flange 181 extends about the entire circumference of the ring 168. In the illustrated embodiment, the flange 181 includes one or more portions spaced apart about the circumference of the ring 168. The flange 181 is formed as a generally flat extension or wall. The flange 181 is configured to engage the upper end of the snap ledge 54 of the retainer ring 36. The engagement of the snap tab 178 of the adapter 132 with the lower end of the snap ledge 54 and the engagement of the flange 181 of the adapter 132 with the upper end of the snap ledge 54 positively and releasably secures the adapter 132 to the retainer ring 36 to prevent axial movement of the adapter 132 relative to the retainer ring 36. The adapter 132 also includes a lock member 180 that extends axially from the lower end of the ring 168. The lock member 180 is an elongated member that is configured to be received within the locking detent 182 of the second elbow 22 to prevent rotation of the adapter 132 relative to the retainer ring 36 and second elbow 22.

The adapter 132 is installed by inserting it through the opening at the end of the retainer ring 36 until the snap tabs 178 of the adapter 132 engage the lower end of the snap edge 54 of the retainer ring 36 and the flange 181 engages the upper end of the snap edge 54. When properly positioned within the retainer ring 36, the boss 172 of the adapter 132 is located at substantially the center of the retainer ring 36 to receive a single screw 76 for attaching the screwable faceplate 30 thereto. It should be understood by one having ordinary skill in the art that although the embodiment of the adapter 132 shown includes only a single threaded boss 172 for receiving one screw for securing a screwable faceplate 30 thereto, other embodiments can be configured to provide a plurality of threaded bosses 172 for attaching screwable faceplates 30 that require a plurality of screws for attaching the screwable faceplate 30 to the adapter 132.

FIGS. 4A-4F illustrate a screwable faceplate 30 for use in an overflow assembly 26. The screwable faceplate 30 includes a face wall 84 having a curved transition portion 86 integrally formed with the face wall 84, and a sidewall 88. The face wall 84 has an outer surface that, when installed, is directed toward the interior of the tub 12 and an inner surface directed toward the retainer ring 36. The transition portion 86 extends between the flat face wall 84 and a cylindrical sidewall 88. The face wall 84 includes an aperture 90 formed substantially through the center thereof. The aperture 90 is configured to receive a screw 76 that is screwed through the aperture 90 and received by the threaded boss 72 of the adapter 32. A notch 92 is formed into a portion of the sidewall 88, wherein the notch 92 extends longitudinally from the edge of the sidewall 88. In an embodiment, the notch 92 extends about between about 10° to 180° of the sidewall 88. The illustrated embodiment of the screwable faceplate 30 includes a single aperture 90 formed though the face wall 84, but it should be understood by one having ordinary skill in the art that the screwable faceplate 30 can also include two or more apertures 90 formed through the face wall 84 to provide for multiple connections between the screwable faceplate 30 and the adapter 32.

To assemble the overflow assembly 26 shown in FIGS. 4A-4D, the second elbow 22 is attached to the distal end of the overflow pipe 16. The seal member 34 is then positioned about the second end 42 of the second elbow 22 such that the seal member 34 is positioned between the second elbow 22 and the outer surface of the sidewall of the tub 12. When properly installed, a portion of the second end 42 of the second elbow 22 extends through the overflow port formed into the sidewall of the tub 12 and into the volume of the tub 12. The retainer ring 36 is then positioned such that the outer threads 50 thereof engage the inner threads 38 of the second elbow 22, and the retainer ring 36 is screwed into place with the second elbow 22. The adapter 32 is then inserted into the retainer ring 36 such that the snap tabs 78 of the adapter 32 engage the snap ledge 54 of the retainer ring 36 and the lock member 80 of the adapter 32 is received in the locking detent 82 of the second elbow 22 Once the adapter 32 is secured to the retainer ring 36 and the second elbow 22, the screwable faceplate 30 is positioned adjacent to the retainer ring 36 and the screw 76 is threaded through the aperture 90 of the screwable faceplate 30 and into the threaded aperture 74 of the adapter 32. As a result, the screwable faceplate 30 is operatively connected to the retainer ring 36 in a second operative mode.

Figure 4E:
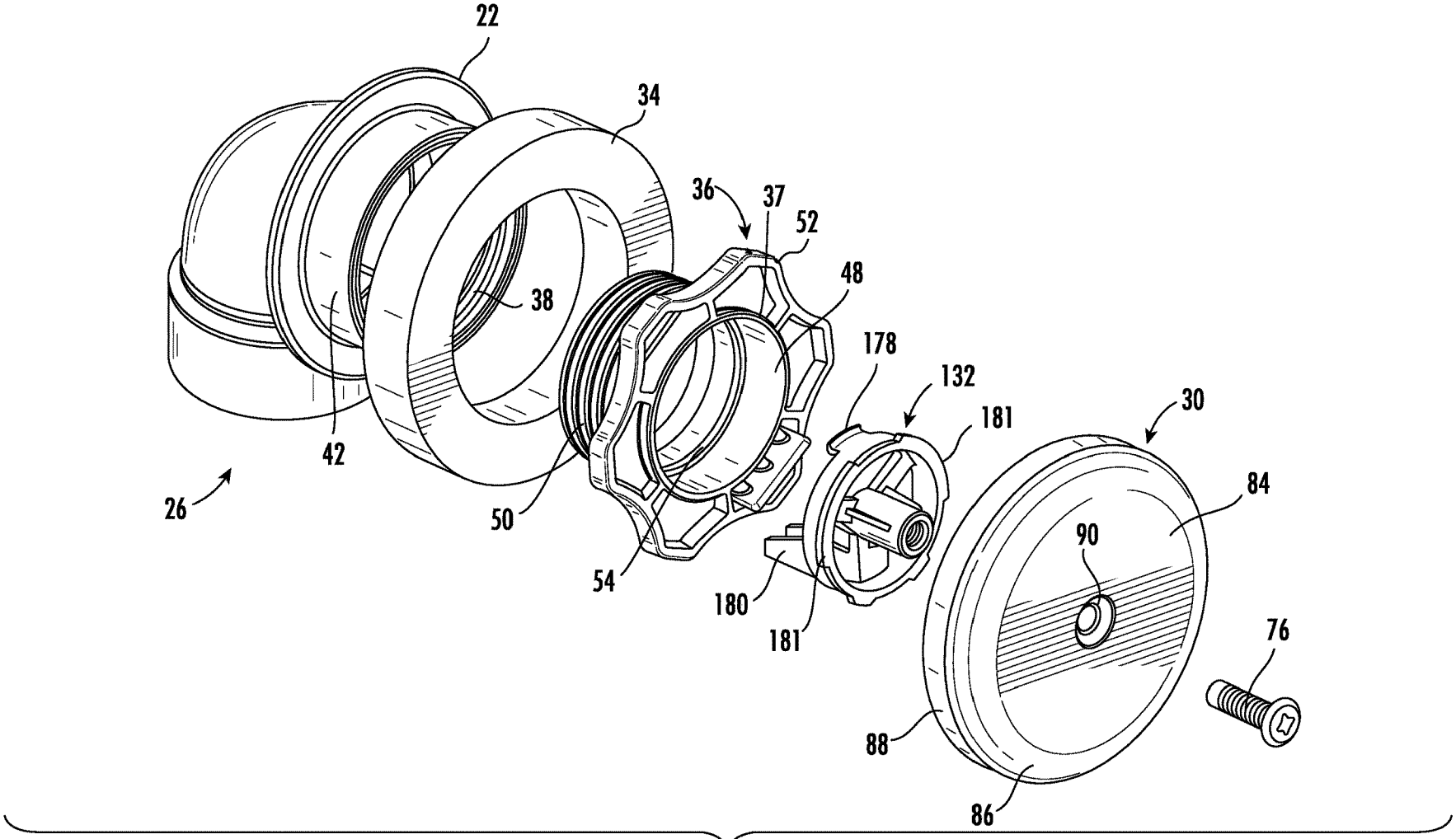
FIG. 4E is an exploded view of another embodiment of the overflow assembly having a screwable faceplate in a second operative mode.
Figure 4F:
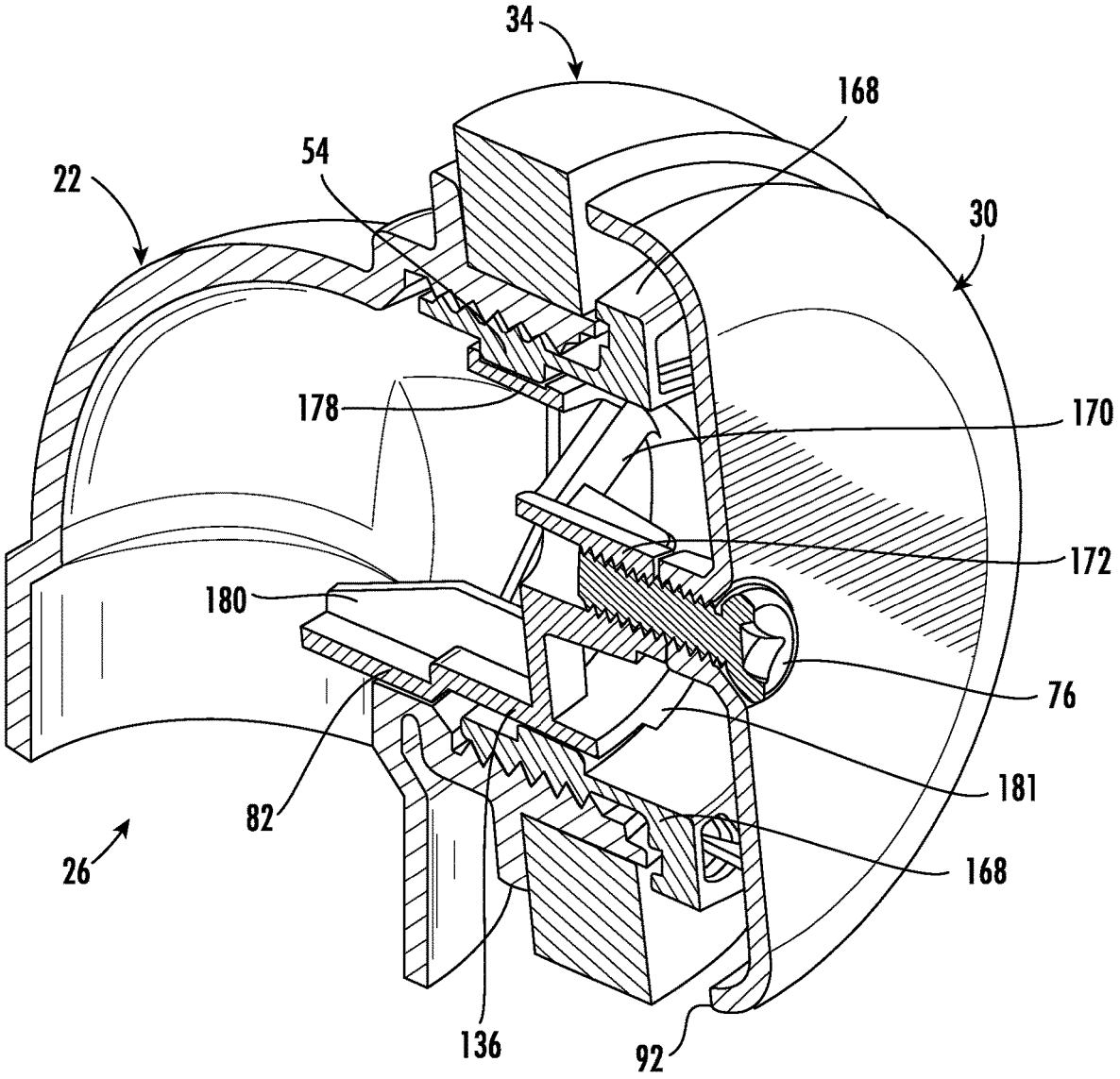
FIG. 4F is an assembled cross-sectional view of the overflow assembly having a screwable faceplate shown in FIG. 4D.
Figure 5A:
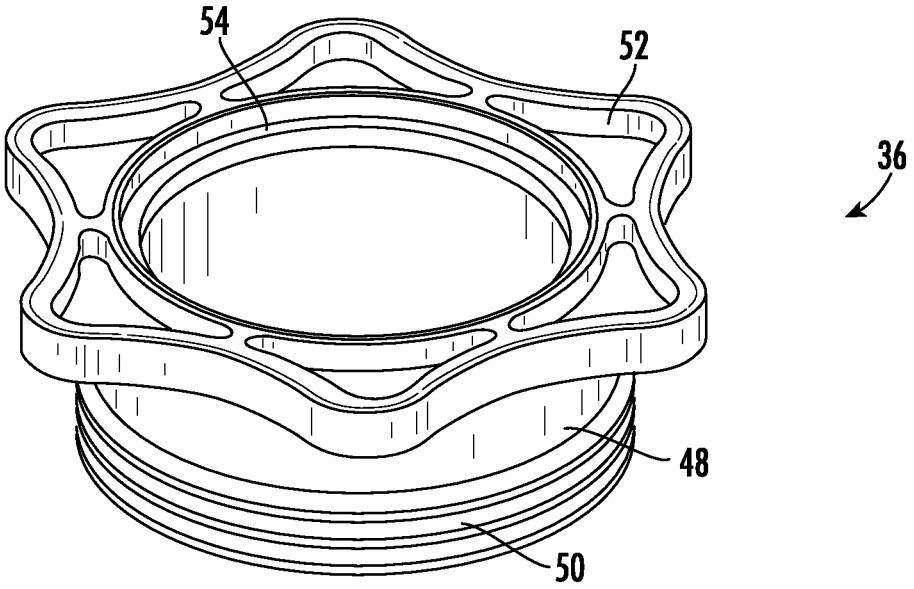
FIG. 5A is an isometric view of an embodiment of a retainer ring.
Figure 5B:
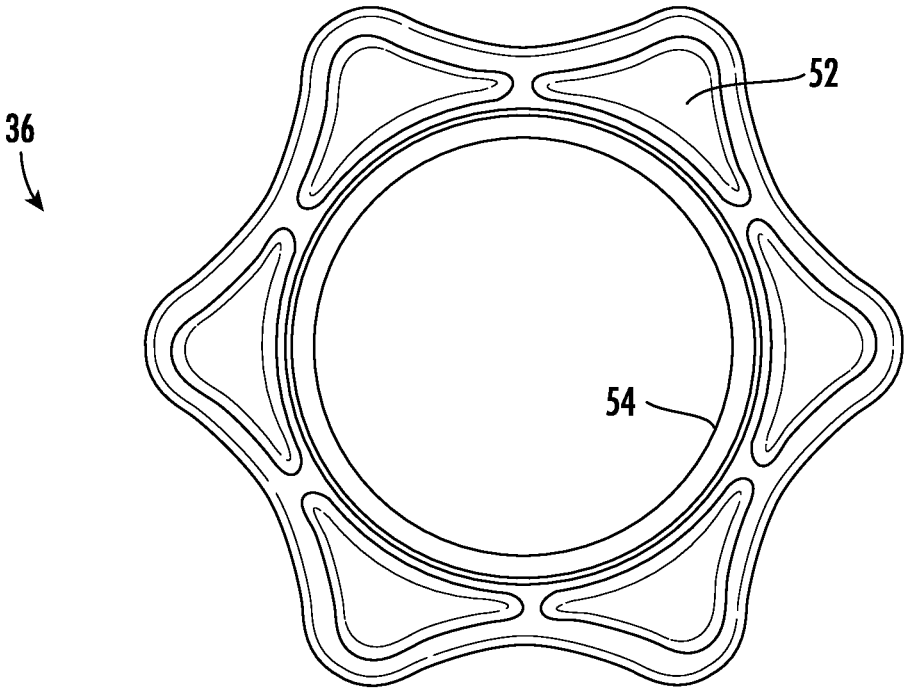
FIG. 5B is a top view of the retainer ring shown in FIG. 5A.
Figure 5C:
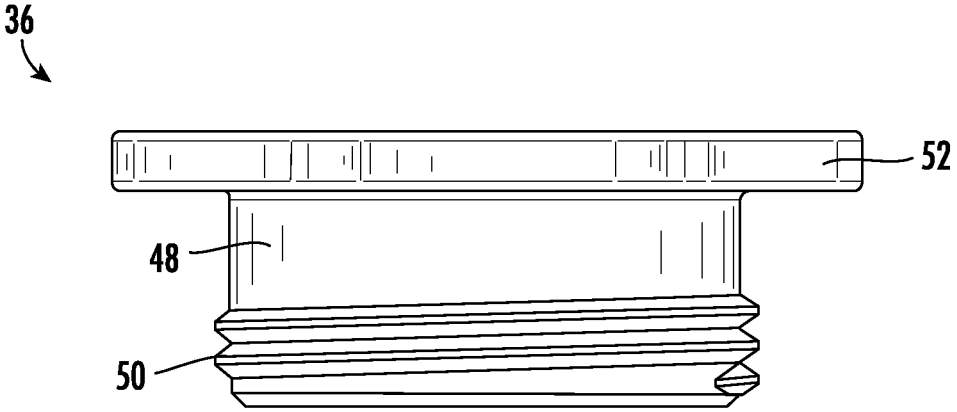
FIG. 5C is a first side view of the retainer ring shown in FIG. 5A.
Figure 5D:
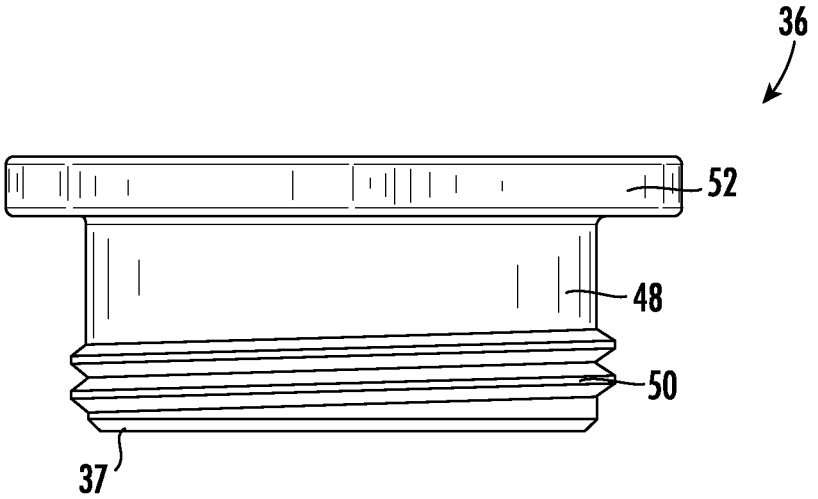
FIG. 5D is a second side view of the retainer ring shown in FIG. 5A.
Figure 6A:
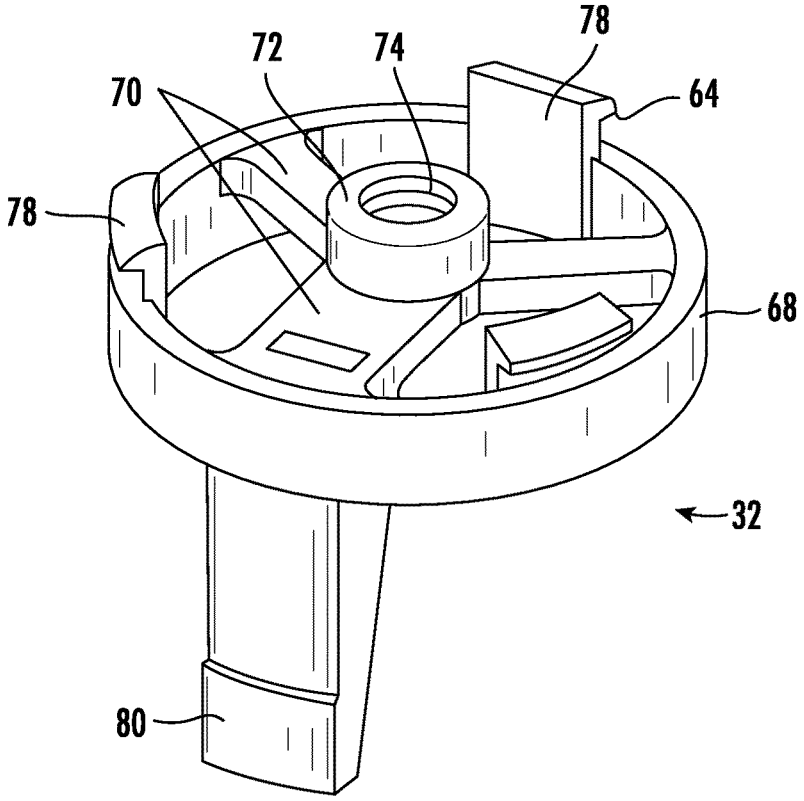
FIG. 6A is an isometric view of a first embodiment of an adapter.
Figure 6B:
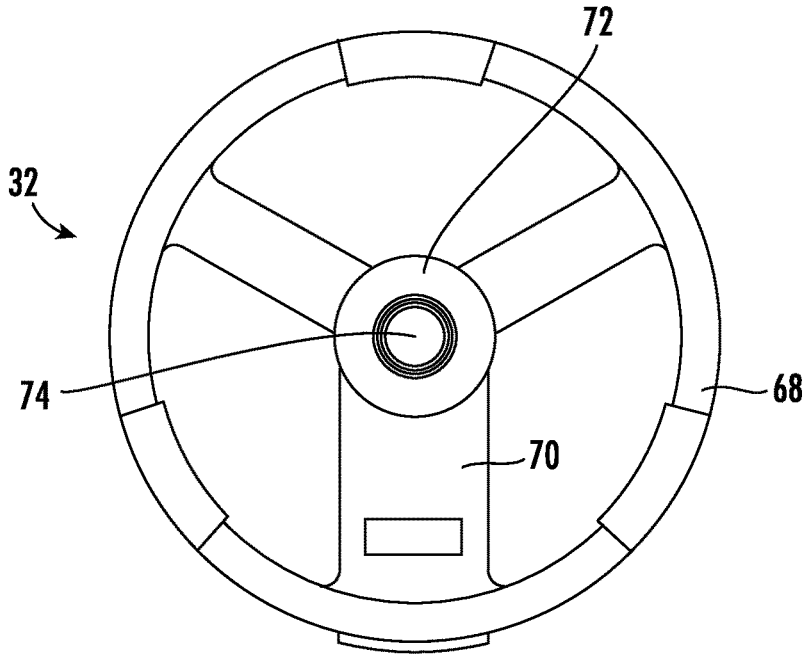
FIG. 6B is a top view of the adapter shown in FIG. 6A.
Figure 6C:
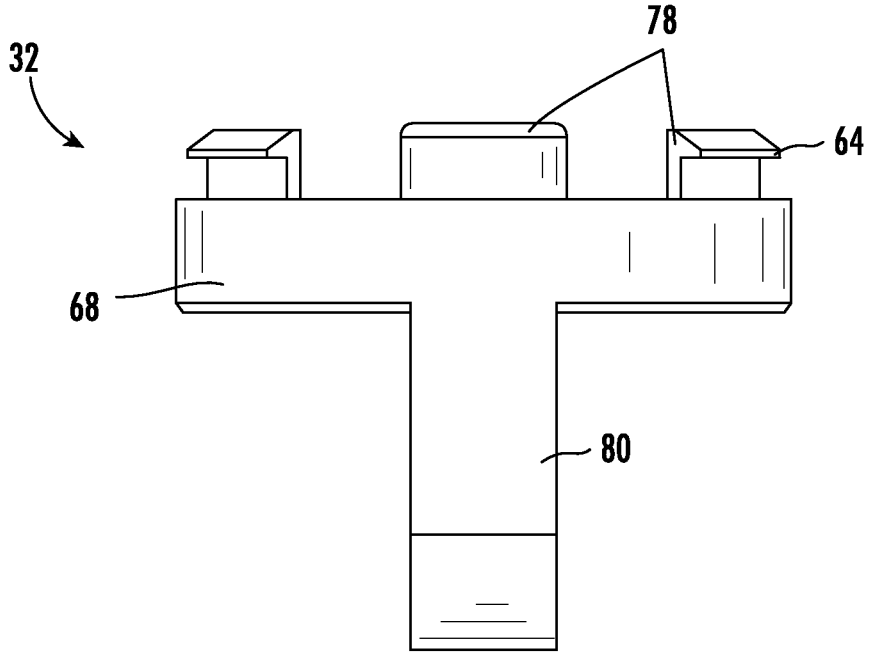
FIG. 6C is a first side view of the adapter shown in FIG. 6A.
Figure 6D:
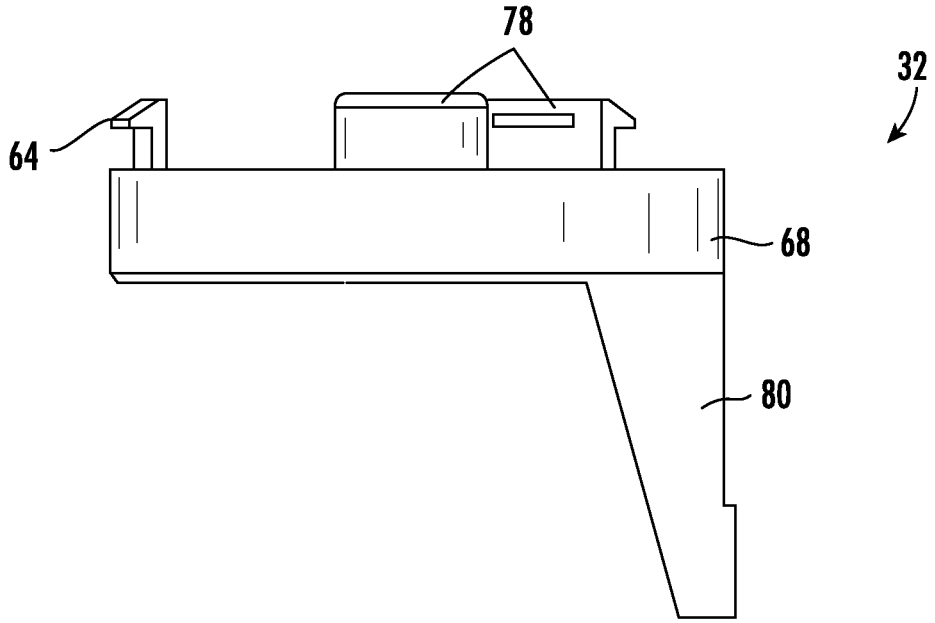
FIG. 6D is a second side view of the adapter shown in FIG. 6A.
Figure 6E:
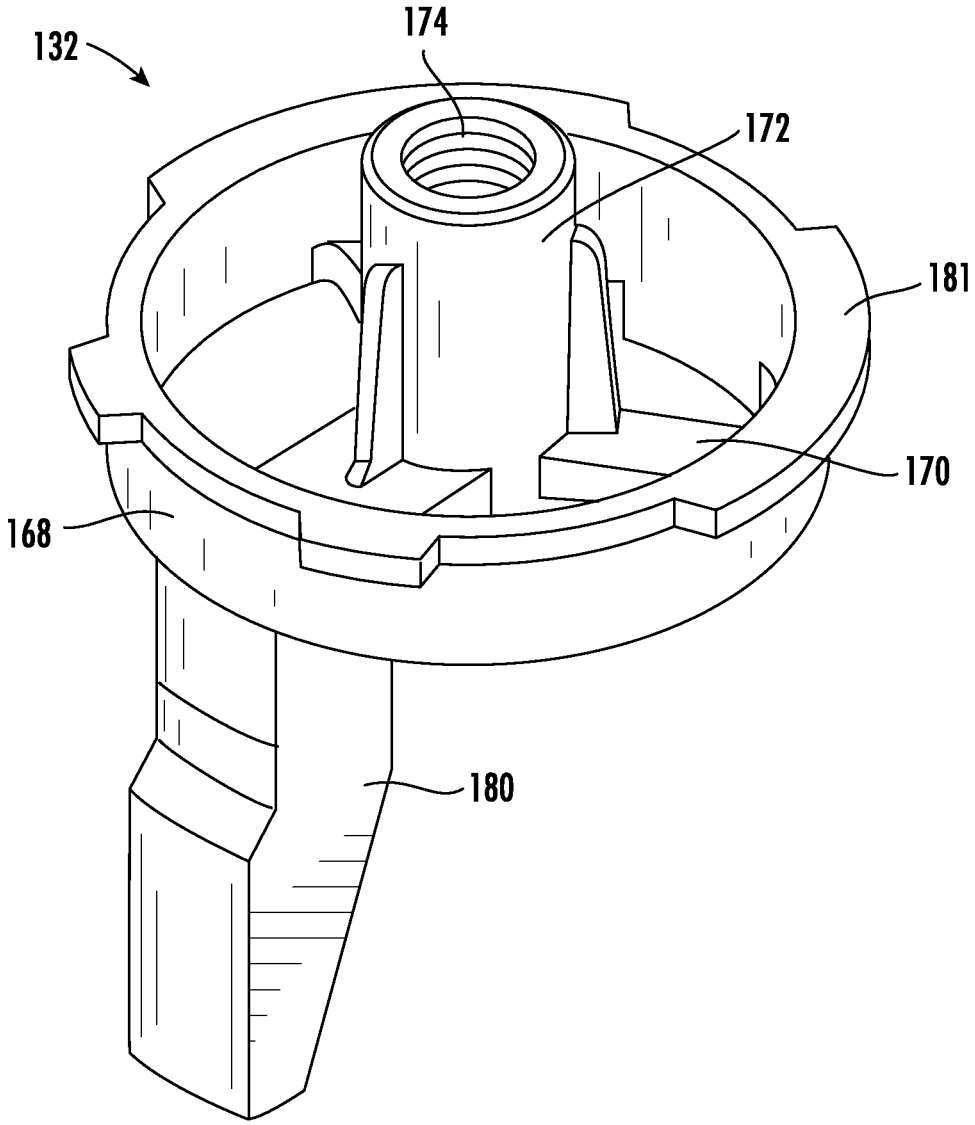
FIG. 6E is an isometric view of another embodiment of an adapter.
Figure 6F:
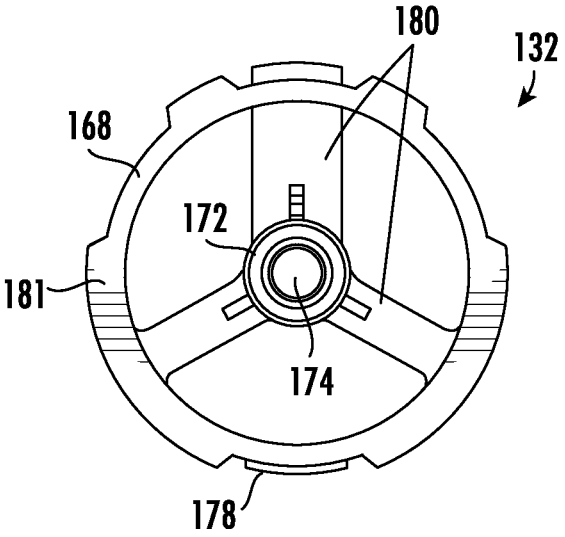
FIG. 6F is a top view of the adapter shown in FIG. 6E.
Figure 6G:
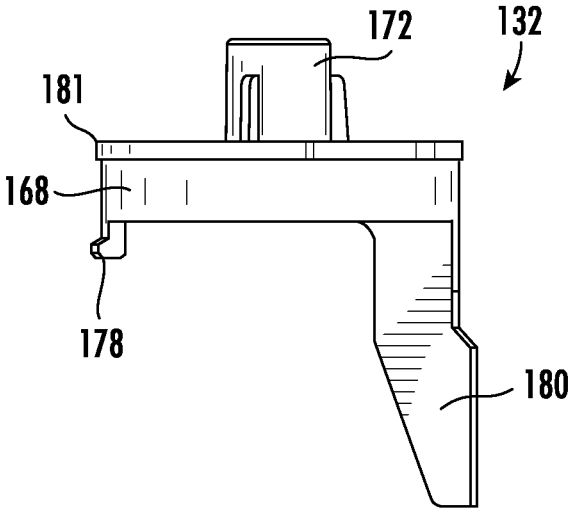
FIG. 6G is a first side view of the adapter shown in FIG. 6E.
Figure 7A:
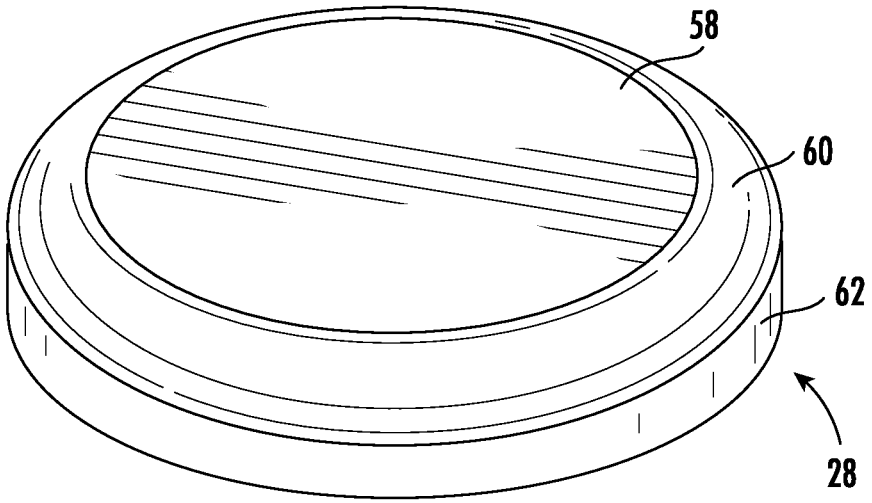
FIG. 7A is an isometric view of a first embodiment of a screwless faceplate.
Figure 7B:
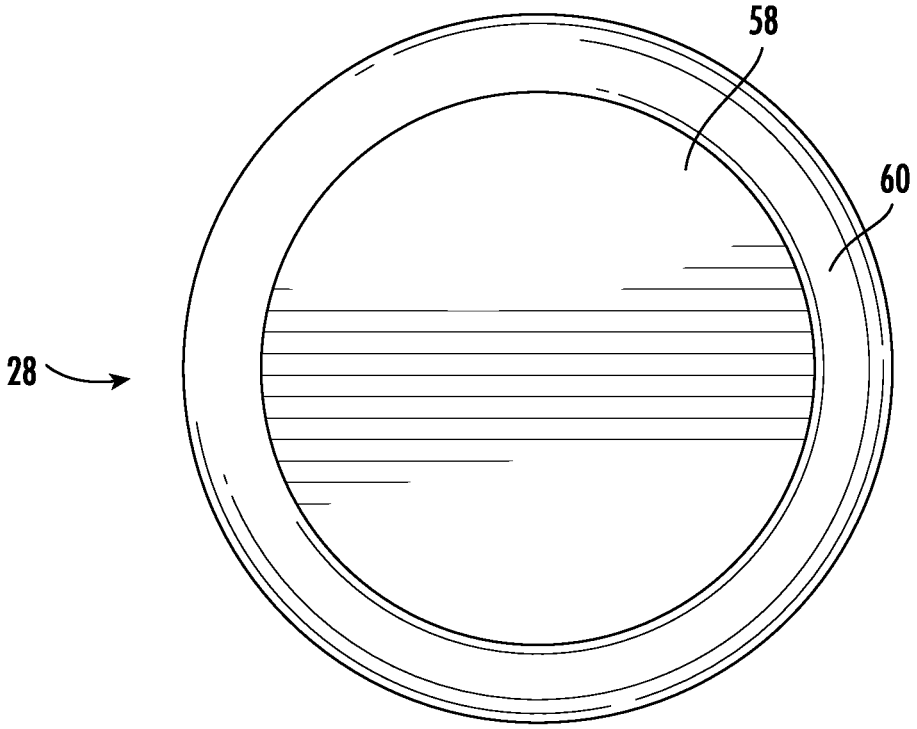
FIG. 7B is a front view of the screwless faceplate shown in FIG. 7A.
Figure 7C:
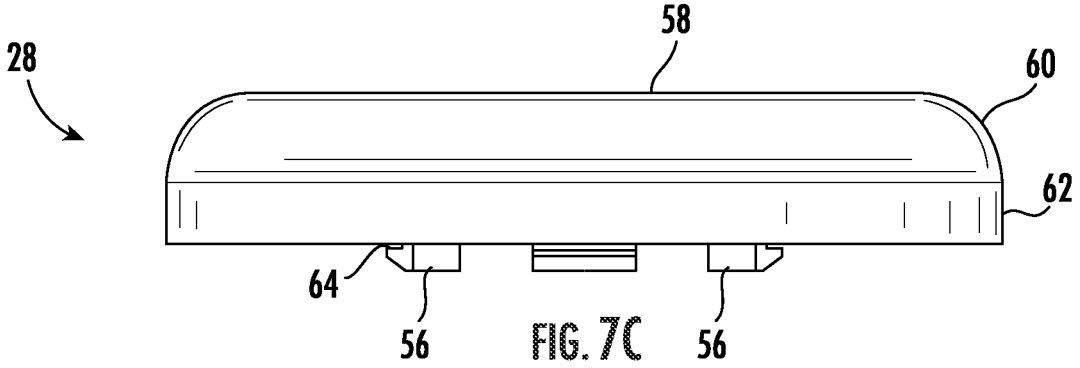
FIG. 7C is a first side view of the screwless faceplate shown in FIG. 7A.
Figure 7D:
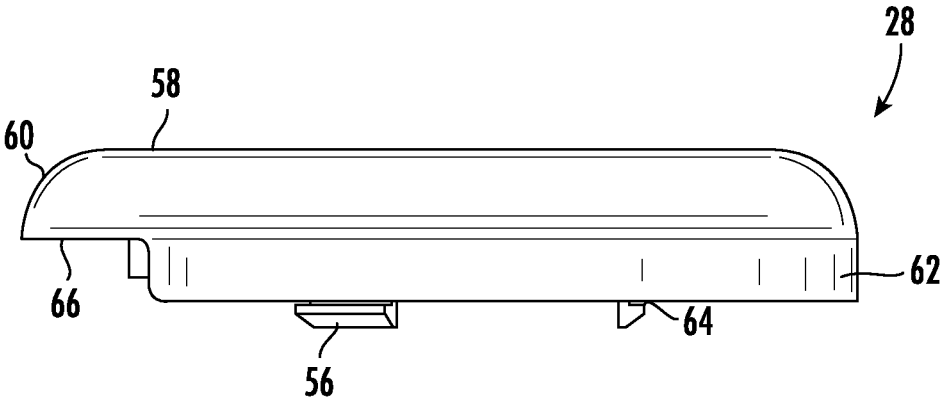
FIG. 7D is a second side view of the screwless faceplate shown in FIG. 7A.
Figure 7E:
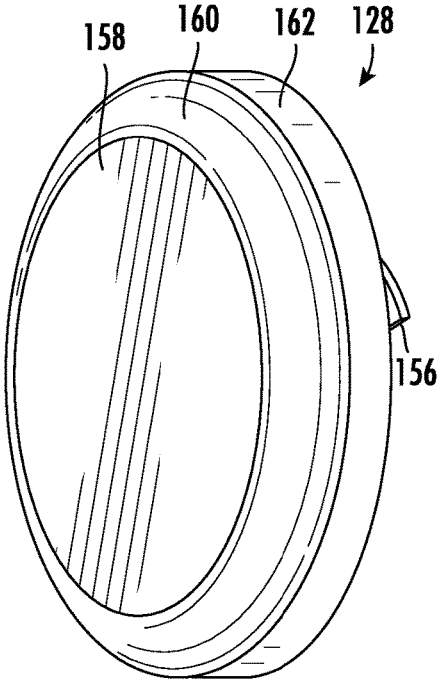
FIG. 7E is an isometric view of another embodiment of a screwless faceplate.
Figure 7F:
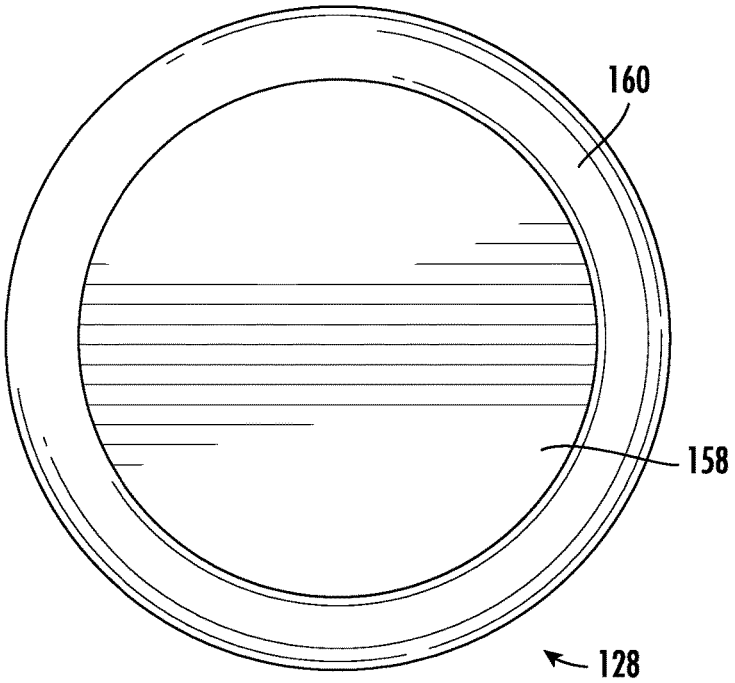
FIG. 7F is a top view of the screwless faceplate shown in FIG. 7E.
Figure 7G:
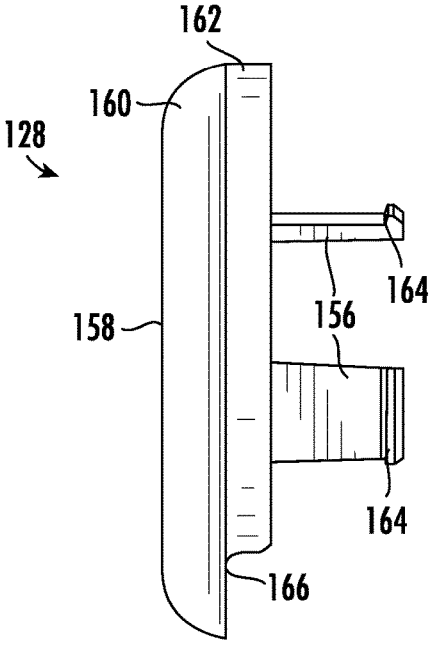
FIG. 7G is a first side view of the screwless faceplate shown in FIG. 7E.
Figure 7H:
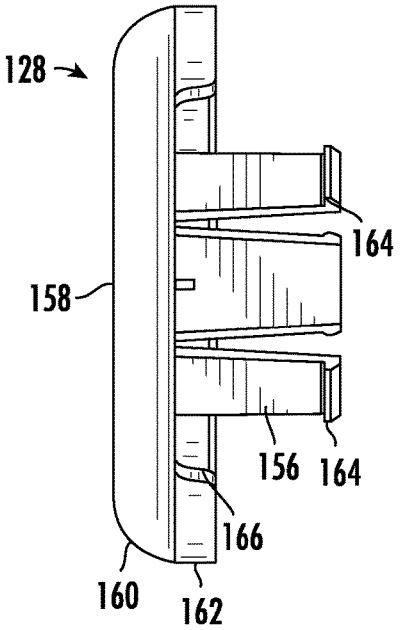
FIG. 7H is a second side view of the screwless faceplate shown in FIG. 7E.

To assemble the overflow assembly 26 shown in FIGS. 4E-4F, the second elbow 22 is attached to the distal end of the overflow pipe 16. The seal member 34 is then positioned about the second end 42 of the second elbow 22 such that the seal member 34 is positioned between the second elbow 22 and the outer surface of the sidewall of the tub 12. When properly installed, a portion of the second end 42 of the second elbow 22 extends through the overflow port formed into the sidewall of the tub 12 and into the volume of the tub 12. The retainer ring 36 is then positioned such that the outer threads 50 thereof engage the inner threads 38 of the second elbow 22, and the retainer ring 36 is screwed into place with the second elbow 22. The adapter 132 is then inserted into the retainer ring 36 such that the snap tab 178 of the adapter 132 engages the lower end of the snap ledge 54 of the retainer ring 36 and the flange 181 engages the upper end of the snap ledge of the retainer ring 36 to lock the adapter 132 to the retainer ring 36. The adapter 132 is rotationally oriented such that the lock member 180 is received in the locking detent 82 of the second elbow 22 to prevent rotation of the adapter 132 relative to the retainer ring 36 and the second elbow 22. Once the adapter 132 is secured to the retainer ring 36 and the second elbow 22, the screwable faceplate 30 is positioned adjacent to the retainer ring 36 and the screw 76 is threaded through the aperture 90 of the faceplate 30 and into the threaded aperture 174 in the boss 172 of the adapter 132.

In one embodiment of the bath waste and overflow system 100, a "full kit" includes the plumbing assembly 27, the drain assembly 24, and an overflow assembly 26, wherein the overflow assembly 26 can include a screwless faceplate 28, a screwable faceplate 30, or both a screwless faceplate 28 and a screwable faceplate 30. A "half kit" of the of the bath waste and overflow system 100 includes an overflow assembly 26 which includes a second elbow 22, a seal member 34, and a retainer ring 36. In one embodiment, the overflow assembly 26 further includes a screwless faceplate. In another embodiment, the "half kit" further includes an adapter 32 and a screwable faceplate 30. In a further embodiment, the "half kit" further includes an adapter 132 and a screwable faceplate 30. In still a further embodiment, a "universal half kit" includes a second elbow 22, a seal member 34, an adapter 32 (or an adapter 132), a retainer ring 36, a screwless faceplate 28, and a screwable faceplate 30.

The overflow assembly 26 of a "universal half kit" has a first operative mode and a second operative mode. The first operative mode of the overflow assembly 26, as shown in FIGS. 3A-3E includes a second elbow 22 having first and second ends wherein the second end includes internal threads 38, a seal member 34 positioned between a portion of the second end 42 and the tub, a retainer ring 36 having external threads 50 and a snap ledge 54 extending radially inward from a body 48 thereof, the retainer ring 36 being threadingly engaged with the second elbow 22, and a screwless faceplate 28, 128 having a plurality of snap tabs 56, 156 removably engaged with the snap ledge 54 of the retainer ring 36. The second operative mode of the overflow assembly 26 of a "universal half kit" or "universal overflow kit" for a bathtub as shown in FIGS. 4A-4F includes a second elbow 22 having first and second ends wherein the second end 42 includes internal threads, a seal member 34 positionable between a portion of the second end 42 and the tub 12, a retainer ring 36 threadingly engageable with the second elbow 22, an adapter 32, 132 engageable with the retainer ring 36, and a screwable faceplate 30, and a screw 76 for screwably connecting the faceplate 30 to the adapter 32, 132.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A universal overflow kit for a bathtub comprising:

an elbow pipe having a first end and a second end;

an annular seal member;

a retainer ring releasably attachable to said second end of said elbow pipe, wherein said seal member is positionable between a portion of said retainer ring and a portion of said second elbow;

an adapter removably attachable within said retainer ring, said adapter including a boss having a threaded aperture formed therethrough;

a screwless faceplate removably connectable to said retainer ring in a first operative mode;

a screwable faceplate; and a screw for removably attaching said screwable faceplate to said adapter in a second operative mode.

2. The universal overflow kit of claim 1, wherein said second end of said elbow pipe includes internal threads and said retainer ring includes a body having external threads formed thereon, wherein said releasable attachment between said retainer ring and said elbow pipe is a threaded engagement.

3. The universal overflow kit of claim 2, wherein said elbow pipe includes a locking detent and said adapter includes an annular ring having a lock member extending therefrom, said lock member of said adapter being received within said locking detent of said elbow pipe to prevent rotation of said adapter relative to said elbow pipe.

4. The universal overflow kit of claim 1, wherein said adapter has an annular ring with a plurality of arms extending radially inward from said ring and said plurality of arms being connected to a boss, wherein the threaded aperture for receiving said screw is formed through said boss.

5. The universal overflow kit of claim 1, wherein said retainer ring includes a cylindrical body, external threads positioned on an outer circumferential surface of said body, a grip flange located adjacent to one end of said body, and a snap ledge extending radially inward from an inner surface of said body.

6. The universal overflow kit of claim 5, wherein said adapter includes at least one snap tab extending from an annular ring for removably engaging said snap ledge of said retainer ring when said adapter is positioned at least partially within said retainer ring in said first operative mode.

7. The universal overflow kit of claim 1, wherein said screwless faceplate includes a face wall, a sidewall, a transition wall extending between said face wall and said sidewall, and a plurality of snap tabs extending from said face wall, said snap tabs are removably engageable with said retainer ring in said second operative mode.

8. An overflow assembly for a bathtub comprising:

an elbow pipe having a first end and a second end, said elbow pipe having internal threads located adjacent to said second end;

a retainer ring having a cylindrical body, external threads being formed on an outer circumferential surface of said body, and a snap ledge extending radially inward from an inner surface of said body, said external threads being threadingly engaged with said internal threads of said elbow pipe; and a faceplate operatively connected to said retainer ring in a first operative mode or a second operative mode.

9. The overflow assembly of claim 8 further comprising an adapter having an annular ring, at least one snap tab extending from an axial end of said ring, a lock member extending from an axial end of said ring, a boss connected to said ring by a plurality of arms extending radially between said boss and said ring, and an internally threaded aperture is formed axially through said boss.

10. The overflow assembly of claim 9, wherein said elbow pipe includes a locking detent positioned adjacent to said internal threads, said lock member of said adapter being received in said locking detent of said elbow pipe to prevent rotation of said adapter relative to said elbow pipe.

11. The overflow assembly of claim 8, wherein said faceplate is a screwless faceplate releasably engaged with said snap ledge of said retainer ring in said first operative mode.

12. The overflow assembly of claim 8 further comprising an adapter positioned at least partially within and connected to said retainer ring, wherein said faceplate is a screwable faceplate releasably attached to said adapter by a screw in said second operative mode.

13. An overflow assembly for a bathtub comprising:

an elbow pipe having a first end and a second end, said elbow pipe having internal threads located adjacent to said second end;

a retainer ring having a cylindrical body, external threads being formed on an outer circumferential surface of said body, and a snap ledge extending radially inward from an inner surface of said body, said external threads being threadingly engaged with said internal threads of said elbow pipe;

an adapter having an annular ring, a boss, a plurality of arms extending between said ring and said boss, a threaded aperture formed through the thickness of said boss, and at least one snap tab extending from a first axial end of said ring, said at least one snap tab engaged with said snap ledge of said retainer ring for releasably securing said adapter to said retainer ring; and a screwable faceplate releasably attached to said adapter by a screw.

14. The overflow assembly of claim 13, wherein said adapter includes a lock member extending from said first axial end of said ring.

15. The overflow assembly of claim 14, wherein said elbow pipe includes a locking detent positioned adjacent to said internal threads, said lock member of said adapter being received in said locking detent of said elbow pipe to prevent rotation of said adapter relative to said elbow pipe.

16. The overflow assembly of claim 14, wherein said adapter includes a second axial end opposite said first axial end and a flange extending radially outward from said second axial end, said flange engaging an upper end of said snap ledge of said retainer ring and said snap tab engaging a lower end of said snap ledge of said retainer ring for removably securing said adapter to said retainer ring.

* * * * *